United States Patent [19]

Maul

[11] 4,177,981

[45] Dec. 11, 1979

[54] COLLATING METHOD AND MACHINE

[75] Inventor: Michael Maul, Schwabach near Nürnberg, Fed. Rep. of Germany

[73] Assignee: Maul Lochkartenkeräte GmbH, Schwabach, Fed. Rep. of Germany

[21] Appl. No.: 894,334

[22] Filed: Apr. 7, 1978

[51] Int. Cl.[2] ..... B65H 39/055

[52] U.S. Cl. ..... 270/58

[58] Field of Search ..... 270/1, 4, 18, 52, 58

[56] References Cited

FOREIGN PATENT DOCUMENTS 517819 1/1931 Fed. Rep. of Germany ..... 270/58

1411689 6/1969 Fed. Rep. of Germany ..... 270/58

*Primary Examiner*—Edgar S. Burr

*Assistant Examiner*—A. Heinz

*Attorney, Agent, or Firm*—Michael J. Striker

[57] ABSTRACT

A collating machine has plural infeed bins and a single outfeed bin. M stacks of copies, each stack consisting of N identical copies, the copies being different from one stack to the other, are laid into infeed bins. In a cyclical sequence, individual copies are transferred from the successive infeed bins to the common outfeed bin. To be able to do this, when the number M of stacks even considerably exceeds the number of infeed bins, the M X N copies are subjected to plural successive collating operations. During each collating operation, the number of infeed bins utilized is less than the number M. During each collating operation, all the M X N copies pass from infeed bins to the common outfeed bin. For the second and any subsequent collating operation, the stacked copies in the outfeed bin are removed and reintroduced into infeed bins, for another collating operation. The number of collating operations performed is such that, upon completion of the last collating operation, the outfeed bin receives the desired N sets of copies, each of the N sets consisting of M copies, each of the M copies within each set coming from a different one of the original M stacks, the M copies within each single set being in the correct sequence.

6 Claims, 27 Drawing Figures

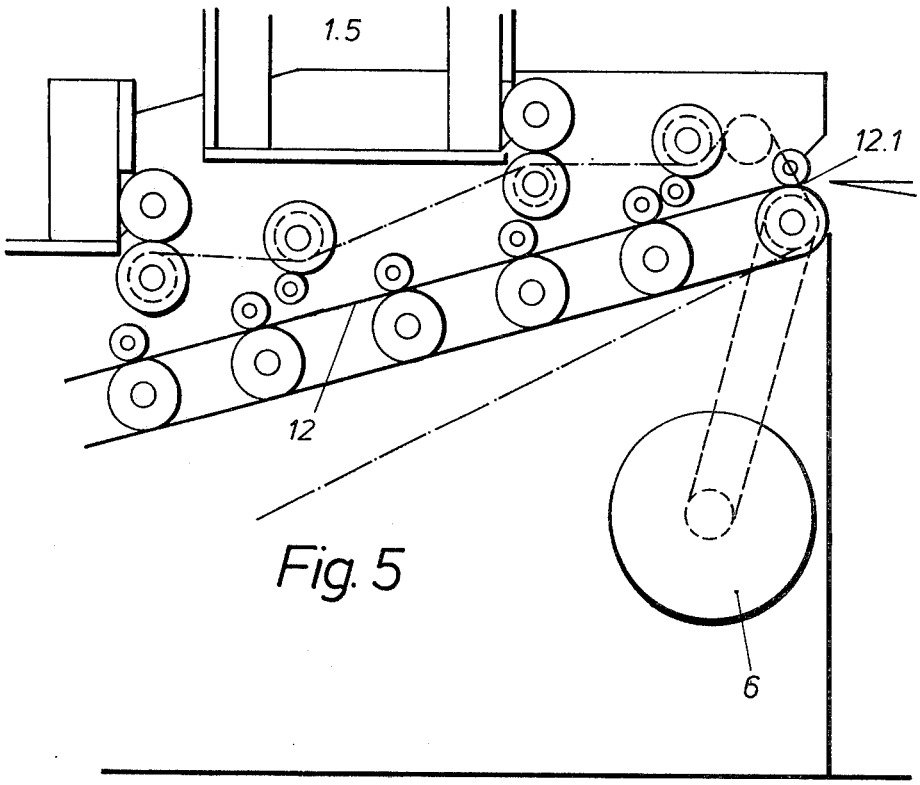
Fig. 5
Fig. 6
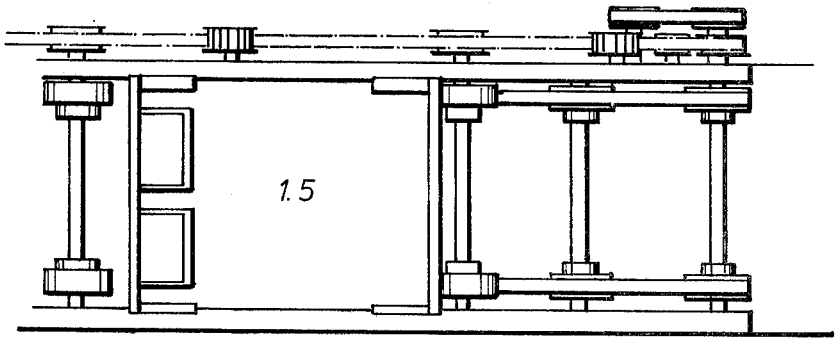

| (1) | (2) | (3) | (4) | (5) |
|---|---|---|---|---|
| 1 – 3 | 2 – 3 | 3 – 3 | 4 – 3 | 5 – 3 |
| 1 – 2 | 2 – 2 | 3 – 2 | 4 – 2 | 5 – 2 |
| 1 – 1 | 2 – 1 | 3 – 1 | 4 – 1 | 5 – 1 |

Fig. 8a

| (1) | (2) | (3) | (4) |
|---|---|---|---|
| 3 - 3 | 6 - 3 | 9 - 3 | 12 - 3 |
| 3 - 2 | 6 - 2 | 9 - 2 | 12 - 2 |
| 3 - 1 | 6 - 1 | 9 - 1 | 12 - 1 |
| 2 - 3 | 5 - 3 | 8 - 3 | 11 - 3 |
| 2 - 2 | 5 - 2 | 8 - 2 | 11 - 2 |
| 2 - 1 | 5 - 1 | 8 - 1 | 11 - 1 |
| 1 - 3 | 4 - 3 | 7 - 3 | 10 - 3 |
| 1 - 2 | 4 - 2 | 7 - 2 | 10 - 2 |
| 1 - 1 | 4 - 1 | 7 - 1 | 10 - 1 |

(5)

| | | |
|---|---|---|
| 10 - 3 | 11 - 3 | 12 - 3 |
| 7 - 3 | 8 - 3 | 9 - 3 |
| 4 - 3 | 5 - 3 | 6 - 3 |
| 1 - 3 | 2 - 3 | 3 - 3 |
| 10 - 2 | 11 - 2 | 12 - 2 |
| 7 - 2 | 8 - 2 | 9 - 2 |
| 4 - 2 | 5 - 2 | 6 - 2 |
| 1 - 2 | 2 - 2 | 3 - 2 |
| 10 - 1 | 11 - 1 | 12 - 1 |
| 7 - 1 | 8 - 1 | 9 - 1 |
| 4 - 1 | 5 - 1 | 6 - 1 |
| 1 - 1 | 2 - 1 | 3 - 1 |

Fig. 8b

| | | |
|---|---|---|
| 12 - 1 | 12 - 2 | 12 - 3 |
| 11 - 1 | 11 - 2 | 11 - 3 |
| 10 - 1 | 10 - 2 | 10 - 3 |
| 9 - 1 | 9 - 2 | 9 - 3 |
| 8 - 1 | 8 - 2 | 8 - 3 |
| 7 - 1 | 7 - 2 | 7 - 3 |
| 6 - 1 | 6 - 2 | 6 - 3 |
| 5 - 1 | 5 - 2 | 5 - 3 |
| 4 - 1 | 4 - 2 | 4 - 3 |
| 3 - 1 | 3 - 2 | 3 - 3 |
| 2 - 1 | 2 - 2 | 2 - 3 |
| 1 - 1 | 1 - 2 | 1 - 3 |

Fig. 8c

Fig. 9a

| (1) | (2) | (3) | (4) | (5) |
|---|---|---|---|---|
| 12 – 3 | 24 – 3 | 36 – 3 | 48 – 3 | 60 – 3 |
| 12 – 2 | 24 – 2 | 36 – 2 | 48 – 2 | 60 – 2 |
| 12 – 1 | 24 – 1 | 36 – 1 | 48 – 1 | 60 – 1 |
| ↑ | ↑ | ↑ | ↑ | ↑ |
| 3 – 3 | 15 – 3 | 27 – 3 | 39 – 3 | 51 – 3 |
| 3 – 2 | 15 – 2 | 27 – 2 | 39 – 2 | 51 – 2 |
| 3 – 1 | 15 – 1 | 27 – 1 | 39 – 1 | 51 – 1 |
| 2 – 3 | 14 – 3 | 26 – 3 | 38 – 3 | 50 – 3 |
| 2 – 2 | 14 – 2 | 26 – 2 | 38 – 2 | 50 – 2 |
| 2 – 1 | 14 – 1 | 26 – 1 | 38 – 1 | 50 – 1 |
| 1 – 3 | 13 – 3 | 25 – 3 | 37 – 3 | 49 – 3 |
| 1 – 2 | 13 – 2 | 25 – 2 | 37 – 2 | 49 – 2 |
| 1 – 1 | 13 – 1 | 25 – 1 | 37 – 1 | 49 – 1 |

Fig. 9b

| (1) | (2) | (3) | (4) | (5) |
|---|---|---|---|---|
| 51 – 3 | 54 – 3 | 57 – 3 | 60 – 3 | |
| 39 – 3 | 42 – 3 | 45 – 3 | 48 – 3 | |
| 27 – 3 | 30 – 3 | 33 – 3 | 36 – 3 | |
| 15 – 3 | 18 – 3 | 21 – 3 | 24 – 3 | |
| 3 – 3 | 6 – 3 | 9 – 3 | 12 – 3 | |
| ↑ | ↑ | ↑ | ↑ | |
| 2 – 1 | 5 – 1 | 8 – 1 | 11 – 1 | |
| 49 – 3 | 52 – 3 | 55 – 3 | 58 – 3 | |
| 37 – 3 | 40 – 3 | 43 – 3 | 46 – 3 | |
| 25 – 3 | 28 – 3 | 31 – 3 | 34 – 3 | |
| 13 – 3 | 16 – 3 | 19 – 3 | 22 – 3 | |
| 1 – 3 | 4 – 3 | 7 – 3 | 10 – 3 | |
| 49 – 2 | 52 – 2 | 55 – 2 | 58 – 2 | |
| 37 – 2 | 40 – 2 | 43 – 2 | 46 – 2 | |
| 25 – 2 | 28 – 2 | 31 – 2 | 34 – 2 | |
| 13 – 2 | 16 – 2 | 19 – 2 | 22 – 2 | |
| 1 – 2 | 4 – 2 | 7 – 2 | 10 – 2 | |
| 49 – 1 | 52 – 1 | 55 – 1 | 58 – 1 | |
| 37 – 1 | 40 – 1 | 43 – 1 | 46 – 1 | |
| 25 – 1 | 28 – 1 | 31 – 1 | 34 – 1 | |
| 13 – 1 | 16 – 1 | 19 – 1 | 22 – 1 | |
| 1 – 1 | 4 – 1 | 7 – 1 | 10 – 1 | |

Fig. 9c

Fig. 9b

| (1) | (2) | (3) | (4) | (5) |
|---|---|---|---|---|
| 58 – 3 | 59 – 3 | 60 – 3 | | |
| 55 – 3 | 56 – 3 | 57 – 3 | | |
| 52 – 3 | 53 – 3 | 54 – 3 | | |
| 1 – 2 | 2 – 2 | 3 – 2 | | |
| 58 – 1 | 59 – 1 | 60 – 1 | | |
| 55 – 1 | 56 – 1 | 57 – 1 | | |
| 52 – 1 | 53 – 1 | 54 – 1 | | |
| 49 – 1 | 50 – 1 | 51 – 1 | | |
| 46 – 1 | 47 – 1 | 48 – 1 | | |
| 43 – 1 | 44 – 1 | 45 – 1 | | |
| 40 – 1 | 41 – 1 | 42 – 1 | | |
| 37 – 1 | 38 – 1 | 39 – 1 | | |
| 34 – 1 | 35 – 1 | 36 – 1 | | |
| 31 – 1 | 32 – 1 | 33 – 1 | | |
| 28 – 1 | 29 – 1 | 30 – 1 | | |
| 25 – 1 | 26 – 1 | 27 – 1 | | |
| 22 – 1 | 23 – 1 | 24 – 1 | | |
| 19 – 1 | 20 – 1 | 21 – 1 | | |
| 16 – 1 | 17 – 1 | 18 – 1 | | |
| 13 – 1 | 14 – 1 | 15 – 1 | | |
| 10 – 1 | 11 – 1 | 12 – 1 | | |
| 7 – 1 | 8 – 1 | 9 – 1 | | |
| 4 – 1 | 5 – 1 | 6 – 1 | | |
| 1 – 1 | 2 – 1 | 3 – 1 | | |

Fig. 9c

| | | |
|---|---|---|
| 60 – 1 | 60 – 2 | 60 – 3 |
| 59 – 1 | 59 – 2 | 59 – 3 |
| 58 – 1 | 58 – 2 | 58 – 3 |
| 57 – 1 | 57 – 2 | 57 – 3 |
| 4 – 1 | 4 – 2 | 4 – 3 |
| 3 – 1 | 3 – 2 | 3 – 3 |
| 2 – 1 | 2 – 2 | 2 – 3 |
| 1 – 1 | 1 – 2 | 1 – 3 |

Fig. 9d

Fig. 11a

| (1) | (2) | (3) | (4) | (5) |
|---|---|---|---|---|
| 25 - 3 | 50 - 3 | | | |
| 25 - 2 | 50 - 2 | | | |
| 25 - 1 | 50 - 1 | | | |
| | | 63 - 3 | | |
| | | 63 - 2 | | |
| | | 63 - 1 | | |
| 6 - 1 | 31 - 1 | 56 - 1 | | |
| 5 - 3 | 30 - 3 | 55 - 3 | | |
| 5 - 2 | 30 - 2 | 55 - 2 | | |
| 5 - 1 | 30 - 1 | 55 - 1 | | |
| 4 - 3 | 29 - 3 | 54 - 3 | | |
| 4 - 2 | 29 - 2 | 54 - 2 | | |
| 4 - 1 | 29 - 1 | 54 - 1 | | |
| 3 - 3 | 28 - 3 | 53 - 3 | | |
| 3 - 2 | 28 - 2 | 53 - 2 | | |
| 3 - 1 | 28 - 1 | 53 - 1 | | |
| 2 - 3 | 27 - 3 | 52 - 3 | | |
| 2 - 2 | 27 - 2 | 52 - 2 | | |
| 2 - 1 | 27 - 1 | 52 - 1 | | |
| 1 - 3 | 26 - 3 | 51 - 3 | | |
| 1 - 2 | 26 - 2 | 51 - 2 | | |
| 1 - 1 | 26 - 1 | 51 - 1 | | |

Fig. 11b

Fig. 11 b

Fig. 11a

| (1) | (2) | (3) | (4) | (5) |
|---|---|---|---|---|
| 55 − 3 | 60 − 3 | — | — | — |
| 30 − 3 | 35 − 3 | 40 − 3 | 45 − 3 | 50 − 3 |
| 5 − 3 | 10 − 3 | 15 − 3 | 20 − 3 | 25 − 3 |
| 5 − 1 | 10 − 1 | 15 − 1 | 20 − 1 | 25 − 1 |
| 54 − 3 | 59 − 3 | — | — | — |
| 29 − 3 | 34 − 3 | 39 − 3 | 44 − 3 | 49 − 3 |
| 4 − 3 | 9 − 3 | 14 − 3 | 19 − 3 | 24 − 3 |
| 54 − 2 | 59 − 2 | — | — | — |
| 29 − 2 | 34 − 2 | 39 − 2 | 44 − 2 | 49 − 2 |
| 4 − 2 | 9 − 2 | 14 − 2 | 19 − 2 | 24 − 2 |
| 54 − 1 | 59 − 1 | — | — | — |
| 29 − 1 | 34 − 1 | 39 − 1 | 44 − 1 | 49 − 1 |
| 4 − 1 | 9 − 1 | 14 − 1 | 19 − 1 | 24 − 1 |
| 53 − 3 | 58 − 3 | 63 − 3 | — | — |
| 28 − 3 | 33 − 3 | 38 − 3 | 43 − 3 | 48 − 3 |
| 3 − 3 | 8 − 3 | 13 − 3 | 18 − 3 | 23 − 3 |
| 53 − 2 | 58 − 2 | 63 − 2 | — | — |
| 28 − 2 | 33 − 2 | 38 − 2 | 43 − 2 | 48 − 2 |
| 3 − 2 | 8 − 2 | 13 − 2 | 18 − 2 | 23 − 2 |
| 53 − 1 | 58 − 1 | 63 − 1 | — | — |
| 28 − 1 | 33 − 1 | 38 − 1 | 43 − 1 | 48 − 1 |
| 3 − 1 | 8 − 1 | 13 − 1 | 18 − 1 | 23 − 1 |
| 52 − 3 | 57 − 3 | 62 − 3 | — | — |
| 2 − 1 | 7 − 1 | 12 − 1 | 17 − 1 | 22 − 1 |
| 51 − 3 | 56 − 3 | 61 − 3 | — | — |
| 26 − 3 | 31 − 3 | 36 − 3 | 41 − 3 | 46 − 3 |
| 1 − 3 | 6 − 3 | 11 − 3 | 16 − 3 | 21 − 3 |
| 51 − 2 | 56 − 2 | 61 − 2 | — | — |
| 26 − 2 | 31 − 2 | 36 − 2 | 41 − 2 | 46 − 2 |
| 1 − 2 | 6 − 2 | 11 − 2 | 16 − 2 | 21 − 2 |
| 51 − 1 | 56 − 1 | 61 − 1 | — | — |
| 26 − 1 | 31 − 1 | 36 − 1 | 41 − 1 | 46 − 1 |
| 1 − 1 | 6 − 1 | 11 − 1 | 16 − 1 | 21 − 1 |

Fig. 11c

Fig. 11c

Fig. 11b

| (1) | (2) | (3) | (4) | (5) |
|---|---|---|---|---|
| 61 – 3 | 62 – 3 | 63 – 3 | — | — |
| 56 – 3 | 57 – 3 | 58 – 3 | 59 – 3 | 60 – 3 |
| 51 – 3 | 52 – 3 | 53 – 3 | 54 – 3 | 55 – 3 |
| 1 – 2 | 2 – 2 | 3 – 2 | 4 – 2 | 5 – 2 |
| 61 – 1 | 62 – 1 | 63 – 1 | — | — |
| 56 – 1 | 57 – 1 | 58 – 1 | 59 – 1 | 60 – 1 |
| 51 – 1 | 52 – 1 | 53 – 1 | 54 – 1 | 55 – 1 |
| 46 – 1 | 47 – 1 | 48 – 1 | 49 – 1 | 50 – 1 |
| 41 – 1 | 42 – 1 | 43 – 1 | 44 – 1 | 45 – 1 |
| 36 – 1 | 37 – 1 | 38 – 1 | 39 – 1 | 40 – 1 |
| 31 – 1 | 32 – 1 | 33 – 1 | 34 – 1 | 35 – 1 |
| 26 – 1 | 27 – 1 | 28 – 1 | 29 – 1 | 30 – 1 |
| 21 – 1 | 22 – 1 | 23 – 1 | 24 – 1 | 25 – 1 |
| 16 – 1 | 17 – 1 | 18 – 1 | 19 – 1 | 20 – 1 |
| 11 – 1 | 12 – 1 | 13 – 1 | 14 – 1 | 15 – 1 |
| 6 – 1 | 7 – 1 | 8 – 1 | 9 – 1 | 10 – 1 |
| 1 – 1 | 2 – 1 | 3 – 1 | 4 – 1 | 5 – 1 |

| | | |
|---|---|---|
| 63 – 1 | 63 – 2 | 63 – 3 |
| 62 – 1 | 62 – 2 | 62 – 3 |
| 61 – 1 | 61 – 2 | 61 – 3 |
| 6 – 1 | 6 – 2 | 6 – 3 |
| 5 – 1 | 5 – 2 | 5 – 3 |
| 4 – 1 | 4 – 2 | 4 – 3 |
| 3 – 1 | 3 – 2 | 3 – 3 |
| 2 – 1 | 2 – 2 | 2 – 3 |
| 1 – 1 | 1 – 2 | 1 – 3 |

Fig. 11d

| B | B + B | I | | | | | II | | | | | III | | | | | IV | | | | |
|---|---|---|---|---|---|---|---|---|---|---|---|---|---|---|---|---|---|---|---|---|---|
| | | (1) | (2) | (3) | (4) | (5) | (1) | (2) | (3) | (4) | (5) | (1) | (2) | (3) | (4) | (5) | (1) | (2) | (3) | (4) | (5) |
| 2 | | x | x | | | | | | | | | | | | | | | | | | |
| 3 | | x | x | x | | | | | | | | | | | | | | | | | |
| 4 | | x | x | x | x | | | | | | | | | | | | | | | | |
| 5 | | x | x | x | x | x | | | | | | | | | | | | | | | |
| 6 | | x | x | x | | | x | x | | | | | | | | | | | | | |
| 7 | 5 + 2 | x | x | x | x | x | x | x | | | | | | | | | | | | | |
| 8 | | x | x | x | x | | x | x | | | | | | | | | | | | | |
| 9 | | x | x | x | | | x | x | x | | | | | | | | | | | | |
| 10 | | x | x | x | x | x | x | x | | | | | | | | | | | | | |
| 11 | 5 + 6 | x | x | x | x | x | x | x | x | | | x | x | | | | | | | | |
| 12 | | x | x | x | x | | x | x | x | | | | | | | | | | | | |
| 13 | 5 + 8 | x | x | x | x | x | x | x | x | x | | x | x | | | | | | | | |
| 14 | 5 + 9 | x | x | x | x | x | x | x | x | | | x | x | x | | | | | | | |
| 15 | | x | x | x | x | x | x | x | x | | | | | | | | | | | | |
| 16 | | x | x | x | x | | x | x | x | x | | | | | | | | | | | |
| 17 | 5 + 12 | x | x | x | x | x | x | x | x | x | | x | x | x | | | | | | | |
| 18 | | x | x | x | | | x | x | x | | | x | x | | | | | | | | |
| 19 | 9 + 10 | x | x | x | | | x | x | x | | | x | x | x | x | x | x | x | | | |
| 20 | | x | x | x | x | x | x | x | x | x | | | | | | | | | | | |
| 21 | 5 + 16 | x | x | x | x | x | x | x | x | x | | x | x | x | x | | | | | | |
| 22 | 6 + 16 | x | x | x | | | x | x | | | | x | x | x | x | | x | x | x | x | |
| 23 | 8 + 15 | x | x | x | x | | x | x | | | | x | x | x | x | x | x | x | x | | |
| 24 | | x | x | x | x | | x | x | x | | | x | x | | | | | | | | |
| 25 | | x | x | x | x | x | x | x | x | x | x | | | | | | | | | | |

Fig. 12

Fig. 13a

| | | | | | | | |
|---|---|---|---|---|---|---|---|
| 1 – 3 | 2 – 3 | 3 – 3 | 4 – 3 | 5 – 3 | 6 – 3 | 7 – 3 | 8 – 3 |
| 1 – 2 | 2 – 2 | 3 – 2 | 4 – 2 | 5 – 2 | 6 – 2 | 7 – 2 | 8 – 2 |
| 1 – 1 | 2 – 1 | 3 – 1 | 4 – 1 | 5 – 1 | 6 – 1 | 7 – 1 | 8 – 1 |

Fig. 13b

| | | | | | | | | |
|---|---|---|---|---|---|---|---|---|
| 8 | – | 1 | 8 | – | 2 | 8 | – | 3 |
| 7 | – | 1 | 7 | – | 2 | 7 | – | 3 |
| 6 | – | 1 | 6 | – | 2 | 6 | – | 3 |
| 5 | – | 1 | 5 | – | 2 | 5 | – | 3 |
| 4 | – | 1 | 4 | – | 2 | 4 | – | 3 |
| 3 | – | 1 | 3 | – | 2 | 3 | – | 3 |
| 2 | – | 1 | 2 | – | 2 | 2 | – | 3 |
| 1 | – | 1 | 1 | – | 2 | 1 | – | 3 |

Fig. 13c

| | | | | | | | | |
|---|---|---|---|---|---|---|---|---|
| 4 | – | 3 | | | | 8 | – | 3 |
| 4 | – | 2 | | | | 8 | – | 2 |
| 4 | – | 1 | | | | 8 | – | 1 |
| 3 | – | 3 | | | | 7 | – | 3 |
| 3 | – | 2 | | | | 7 | – | 2 |
| 3 | – | 1 | | | | 7 | – | 1 |
| 2 | – | 3 | | | | 6 | – | 3 |
| 2 | – | 2 | | | | 6 | – | 2 |
| 2 | – | 1 | | | | 6 | – | 1 |
| 1 | – | 3 | | | | 5 | – | 3 |
| 1 | – | 2 | | | | 5 | – | 2 |
| 1 | – | 1 | | | | 5 | – | 1 |

| | | |
|---|---|---|
| 8 | – | 3 |
| 4 | – | 3 |
| 8 | – | 2 |
| 4 | – | 2 |
| 8 | – | 1 |
| 4 | – | 1 |
| 7 | – | 3 |
| 3 | – | 3 |
| 7 | – | 2 |
| 3 | – | 2 |
| 7 | – | 1 |
| 3 | – | 1 |
| 6 | – | 3 |
| 2 | – | 3 |
| 6 | – | 2 |
| 2 | – | 2 |
| 6 | – | 1 |
| 2 | – | 1 |
| 5 | – | 3 |
| 1 | – | 3 |
| 5 | – | 2 |
| 1 | – | 2 |
| 5 | – | 1 |
| 1 | – | 1 |

Fig.13d

| (1) | | | (2) | | |
|---|---|---|---|---|---|
| 6 | – | 3 | 8 | – | 3 |
| 2 | – | 3 | 4 | – | 3 |
| 6 | – | 2 | 8 | – | 2 |
| 2 | – | 2 | 4 | – | 2 |
| 6 | – | 1 | 8 | – | 1 |
| 2 | – | 1 | 4 | – | 1 |
| 5 | – | 3 | 7 | – | 3 |
| 1 | – | 3 | 3 | – | 3 |
| 5 | – | 2 | 7 | – | 2 |
| 1 | – | 2 | 3 | – | 2 |
| 5 | – | 1 | 7 | – | 1 |
| 1 | – | 1 | 3 | – | 1 |

| | | |
|---|---|---|
| 8 | – | 3 |
| 6 | – | 3 |
| 4 | – | 3 |
| 2 | – | 3 |
| 8 | – | 2 |
| 6 | – | 2 |
| 4 | – | 2 |
| 2 | – | 2 |
| 8 | – | 1 |
| 6 | – | 1 |
| 4 | – | 1 |
| 2 | – | 1 |
| 7 | – | 3 |
| 5 | – | 3 |
| 3 | – | 3 |
| 1 | – | 3 |
| 7 | – | 2 |
| 5 | – | 2 |
| 3 | – | 2 |
| 1 | – | 2 |
| 7 | – | 1 |
| 5 | – | 1 |
| 3 | – | 1 |
| 1 | – | 1 |

Fig. 13e

| (1) | | | (2) | | |
|---|---|---|---|---|---|
| 7 | – | 3 | 8 | – | 3 |
| 5 | – | 3 | 6 | – | 3 |
| 3 | – | 3 | 4 | – | 3 |
| 1 | – | 3 | 2 | – | 3 |
| 7 | – | 2 | 8 | – | 2 |
| 5 | – | 2 | 6 | – | 2 |
| 3 | – | 2 | 4 | – | 2 |
| 1 | – | 2 | 2 | – | 2 |
| 7 | – | 1 | 8 | – | 1 |
| 5 | – | 1 | 6 | – | 1 |
| 3 | – | 1 | 4 | – | 1 |
| 1 | – | 1 | 2 | – | 1 |

| | | |
|---|---|---|
| 8 | – | 3 |
| 7 | – | 3 |
| 6 | – | 3 |
| 5 | – | 3 |
| 4 | – | 3 |
| 3 | – | 3 |
| 2 | – | 3 |
| 1 | – | 3 |
| 8 | – | 2 |
| 7 | – | 2 |
| 6 | – | 2 |
| 5 | – | 2 |
| 4 | – | 2 |
| 3 | – | 2 |
| 2 | – | 2 |
| 1 | – | 2 |
| 8 | – | 1 |
| 7 | – | 1 |
| 6 | – | 1 |
| 5 | – | 1 |
| 4 | – | 1 |
| 3 | – | 1 |
| 2 | – | 1 |
| 1 | – | 1 |

COLLATING METHOD AND MACHINE

BACKGROUND OF THE INVENTION

In the context of the present invention, one can broadly refer to "sheets", to the extent that it is understood that the term "sheet" is intended to cover a variety of items, including cards, documents, checks, film, and so forth, differing fom one another only with respect to material, thickness and size. Because the invention relates to sheets of different types, e.g., cards or even film aperture cards of flat film, the present disclosure will often speak on a general level concerning "sheets", and usually in terms of "cards" when referring to exemplary embodiments of the invention.

There exist a host of machines of varying types all performing the following operation. Of a plurality (e.g., M) of different originals or "pictures", N copies of each single one of the M originals are to be produced. The number N is the same for each one of the M masters. Accordingly, one can speak of M groups (each group different) each consisting of N identical copies. These copies are to be so assembled as to form N "sets" of copies, each set consisting of M different copies, with the M different copies of each single set being arranged in the same sequence as the sequence in which the M groups of N identical copies each were received for compilation. The copies can for example be the individual pages of a catalog or book, and one "set" of copies can correspond to the complete catalog or book, or the like.

To elucidate the basic type of problem to which the invention relates, a simple example will be set forth. Assume that cards of some type are involved. Five copies are made from each one of four different originals A/B/C/D. The stacks of copies are constituted in the following way, with the number system employed starting from the end of each stack, for the sake of correspondence with the detailed description to follow. For the sake of brevity, the term "copy" or "copies" repeatedly used herein is abbreviated to CP.

| CP-Arrangement in 4 Groups A B C D (M = 4) | | | | |
|---|---|---|---|---|
| A 5 | B 5 | C 5 | D 5 | |
| A 4 | B 4 | C 4 | D 4 | with 5 identical cards #1, 2, 3, 4, 5 within |
| A 3 | B 3 | C 3 | D 3 | each group (N = 5) |
| A 2 | B 2 | C 2 | D 2 | |
| A 1 | B 1 | C 1 | D 1 | |

Thus, there are a total of 4 CP-stacks, each consisting of five identical cards (20 cards in all). These are to be rearranged to form five sets (N=5) each consisting of four (M=4) different cards A, B, C, D. Thus, the following arrangement must be produced (to avoid confusion between the numbers utilized to identify copy number, and the numbers utilized to identify infeed stations or bins, the latter numbers always appear in parantheses):

| 5 sets (N = 5) in 5 stations | | | | | |
|---|---|---|---|---|---|
| (1) | (2) | (3) | (4) | (5) | |
| D 1 | D 2 | D 3 | D 4 | D 5 | each of the five sets including one card |
| C 1 | C 2 | C 3 | C 4 | C 5 | from each of the 4 different groups |
| B 1 | B 2 | B 3 | B 4 | B 5 | (M = 4) |

-continued

| 5 sets (N = 5) in 5 stations | | | | |
|---|---|---|---|---|
| (1) | (2) | (3) | (4) | (5) |
| A 1 | A 2 | A 3 | A 4 | A 5 |

The conversion from the CP-arrangement of groups to the arrangement in sets, can be performed in one of the two following ways:

(a) The formation of one set from the individual letter stacks (the A, B, C, D stacks) of the CP arrangement of groups is performed in such a way that one removes the lowest cards A, B, C, D from the four CP-stacks one after the other and lays them in succession one atop the other such that A is located at the bottom of the thusly formed set and D at the top. In this way, the first complete set is formed. The same is done for the next-higher line "2" of the CP-arrangement tabulated above, and so forth, until all five sets have been formed. Thus, this manner of forming the sets involves removal of cards from the different stacks and "compiling" of the assembled cards to form an individual set, set by set. Machines which operate on this basis are typically referred to as "compiling machines" or "collators".

(b) However, the same end result can be achived by "distributing" the copies, or better said by "distributive sorting" of the copies, i.e., the cards of each CP-stack are distributed onto collecting stations or bins. Referring to the "CP-Arrangement" table above, one takes first the vertical A-stack and "sorts" the A-cards into 5 successively located stations of the set-forming set-up. The same is then done for the B-cards, for the C-cards, and for the D-cards, in turn, so that when finished the cards taken from the D-stack occupy the uppermost positions on the five thusly formed stacks, as indicated in the "5 sets" tabulation above. Machines which form the sets in question in this manner are typically designated "sorters", both in the English language and in German.

When, as in the illustrative example just given, only a few different originals and only a few copies per original are involved, both set-forming procedures outlined above can be readily performed by hand or using fairly simple machines. If, for example, price lists, circulars, etc., are to be assembled into a limited number of sets, the "compiling" can be performed using a row of 10 supply bins or stacks (or stations), using a gripper which travels along the row of 10 bins and pulls from each one one copy, and then deposits the 10 copies onto a stacking table (or an outfeed bin), these 10 copies constituting one "set".

With the next traverse of the gripper along the row of supply bins, the next complete set is formed and deposited, and so forth. If one is not using a "compiling" technique but instead a "distributive sorting" technique, then use is made of 10 collecting stations. First one CP-stack has its 10 copies distributed into the 10 stations; then this is done for the next CP-stack; and so forth.

Self-evidently, with both methods, fewer than ten originals may be involved, e.g., seven different price-list sheets. In that event, for the example just given, only seven of the ten supply bins would be employed for the first technique, and only seven of the ten collecting stations would employed for the second technique.

Having defined what is meant by "collating" and by "sorting", it is noted that the present invention relates to "collating".

SUMMARY OF THE INVENTION

As just stated, the present invention relates to "collating" methods and machines, the term "collating" having just been defined and distinguished from "sorting". In particular, it is a general object of the invention to be able to collate, especially in large-quantity situations, without requiring so many supply or infeed bins. This is achieved by resorting to a plural-runthrough technique, described in detail below. For example, if an arbitrarily high number of copies is made from each one of 25 different originals, and therefore that arbitrarily high number of complete sets is to be formed, it is an object of the invention to be able to collate without using 25 infeed bins. Furthermore, when a very large number of sets (copies per original) is involved, it is not to be required that the capacity of each individual infeed bin match up to so large a number of copies; instead, the collating is to be performed in such a manner that the large number of copies involved are laid into the infeed bins continually.

The reduction in the number of infeed bins needed is achieved, mainly, by resorting to a plural-runthrough technique, according to which copies involved in one job are subjected to a plurality of successively performed collating operations, the last of which plurality actually yields the desired collated sets of copies. As a result of this, the same infeed bins can be used to accommodate successive groups of pictures; i.e., it is not necessary that there be, for all the copies made from a single one of the originals, a single respective infeed bin which is to accommodate all those copies and which is not to accommodate copies made from any of the other originals.

The invention contemplates a collating technique equally applicable to sheets and cards of all types, e.g., microfiches and film aperture cards as well as documents and the like. Of course, the collating equipment must be constructed or adjusted to handle the material and dimensions involved. The simplest solution is available when the copies are of standardized dimensions, as is the case for example with film aperture cards and microfiches. If a single collating machine is to be capable of handling copies of different dimensions, then use must be made of the conventional structural expedients utilized for such changeovers on ordinary collating machines.

The invention is intended for the specific case where the outfeed bin receives exactly the same number of copies from each individual one of the plural infeed bins, and furthermore, where the feeding of cards from the infeed bins to the outfeed bin proceeds in the same sequence as the sequence in which the copies in each single set to be formed are to be arranged within such set.

For example, assume that five infeed bins are to be employed, and that they are arranged equally spaced from one another along a common infeed conveyor which leads to the outfeed bin. If, now, simultaneoulsy at all the five infeed bins, one card is pushed out from the bin onto the common infeed conveyor, five cards will be simultaneously deposited onto the conveyor, and furthermore will be arranged on the conveyor in a sequence corresponding to the different distances of the five infeed bins from the outfeed bin. I.e., of the five cards simultaneously pushed onto the common conveyor (one from each infeed bin), the first card in the succession of five cards is the one from the infeed bin nearest to the outfeed bin; likewise, the last card in the succession of five cards is the one from the bin farthest from the outfeed bin. Thus, when this succession of five simultaneoulsy pushed-out cards is now fed to the outfeed bin, the outfeed bin receives them in sequence.

Indeed, the explanatory example just mentioned is the preferred way of fully utilizing the highest reliable speed at which cards can be fed out from the individual infeed bins; i.e., it is preferred that the cards be fed out from all infeed bins simultaneously, and be simultaneously fed onto the common infeed conveyor. Of course, the infeed conveyor must then operate at, so to speak, five-times normal speed; i.e., the five cards simultaneously deposited onto the infeed conveyor must be transported away from the five infeed bins to the common outfeed bin at a speed high enough, to assure that the last of the five cards (the one from the farthest infeed bin) has cleared the first infeed bin (the one nearest to the outfeed bin), before the next pushing-out of cards from the five infeed bins. However, it is relatively easy to establish a high transport speed for the common infeed conveyor, certainly much easier than to increase the speed at which cards are pushed out from the infeed bins.

Actually, this particular capability of a "collating" machine having plural infeed bins and a single outfeed bin is what constitutes the main advantage relative to a "sorting" machine, i.e., relative to a machine having a single infeed bin and plural outfeed bins. With a "sorting" machine, the productivity of the machine is limited mainly by the speed at which successive individual cards can be removed from the infeed bin. In contrast, with a "collating" machine, if the rate at which individual cards can be removed from one infeed bin is the same as for a "sorting" machine, the use of, e.g., 5 infeed bins makes possible a five-fold increase in the productivity of the machine.

For this reason, the inventive technique, which utilizes plural infeed bins, is of most particular interest in applications where extremely high collating productivity is demanded.

The inventive sorting technique and equipment fulfills the following task:

to take M groups of sheets, each group consisting of N identical sheets, the sheets of each group being different from those of the other groups, and by means of collating, converting the M groups into N sets, the M sheets within each single set each coming from a different respective one of the M groups, the sequence of the M sheets within each single set being the same as the sequence in which the M groups were received for collating, this being achieved in the following way:

all the sheets involved in one collating job are subjected to a plurality of successive collating operations, during each single collating operation, all sheets in all supply bins utilized for the collating operation are transferred into the common collecting bin, for each single collating operation (except the first) the sheets in the collecting bin at the completion of the preceding collating operation are removed from the collecting bin without disturbing their sequence, and without disturbing their sequence distributed into the supply bins, whereupon this (next) collating operation is performed, during each card-feeding cycle within each collating operation, the number of cards fed in sequence to the outfeed bin is determined by the number of infeed bins utilized for the collating operation, so that, upon completion of the last of the successive collating operations, the outfeed bin actually contains the sets desired, i.e., with the sheets of each set in the desired sequence within the respective set, and furthermore with the sets themselves in the correct sequence (if it happens that the individual sets can be physically distinguished from one another).

This definition of what is done is somewhat oversimplified and is put forth only initially; the definition of the inventive procedure is expanded on a step-by-step basis, in the detailed description further below.

The inventive technique can, in certain situations, be feasibly implemented manually, but more generally by machine, and even utilizing otherwise conventional collating machines, at least in certain situations. The inventive technique involves new procedural steps for a collating job, and furthermore contemplates the provision of a collating machine capable of collating in accordance with the inventive technique, irrespective of the particular job (the number of sets to be formed, and the number of sheets which each individual set will contain), using a small number of infeed bins.

To again draw a distinction relative to prior art, it is to be again noted that conventional collating machines require a number of infeed bins equal in number to the number of sheets which will be contained in each individual set to be formed. With such conventional machines, one cannot feed to the machine a number M of CP-groups in excess of the number of available infeed bins. If the number of sheets in each individual set to be formed exceeds the number of available infeed bins, the collating job must be broken down into two or more separate collating jobs, each of which the machine can perform. For example, if 10 copies have been made from each one of 10 originals A to K (100 copies in all, 10 sets to be formed, each set to contain 10 sheets A to K), and if only five infeed bins are available, then the first five stacks A to E are laid into the five bins, and collated, after which the outfeed bin contains 10 half-sets, which are then removed and, e.g., laid onto a sorting rack. Then, the remaining five stacks F to K are laid into the five bins, and collated, after which the outfeed bin contains again 10 half-sets, which are then removed and, e.g., carried to the sorting rack and manually combined with the 10 half-sets already there.

When the technique of the present invention is employed, there is no limit to how many sheets are to be contained within each single set to be formed.

Machines are known provided with selecting means which can be used to select the number of infeed bins to be used during a collating operation. The user changes the setting of the selecting means, for example, when the number of originals from which copies were made is lower than the number of infeed bins at his disposal. German Pat. No. 517,819 (inventor Tauschek) discloses an example of a machine in which sheets are fed from plural infeed bins into a single common outfeed bin, and mentions the possibility of collating actually using plural infeed bins. German Pat. No. 1,411,689 discloses a technique for collating to form carbon-paper packets, i.e., consisting of an original, a first copy, a second copy, and so forth, but interleaved with identical carbon-paper sheets. Because, in each set (carbon-paper packet) to be formed, each one of every second sheet (i.e., all the carbon-paper sheets) are identical, wheres the original, first copy, second copy, etc., may differ, and to reduce the number of infeed bins employed, one bin is provided for the group of uncollated originals, another for the group of uncollated first copies, a third for the group of uncollated second copies, and so forth, in the usual way; however, the all-identical carbon-paper sheets, are all put into a single infeed bin, so that this infeed bin contains more sheets than the other infeed bins. While these various machines and techniques are of interest, they do not exhibit te capacity of the inventive technique, nor important procedural step of the invention technique. This will become clear further below.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 5 is an enlarged-scale view of the part of the machine of FIG. 1 near the infeed bin 1.5 thereof;

FIG. 6 is a top view looking down on the structure shown in FIG. 5;

FIGS. 7 to 11 are tabulations which define what occurs during collating operations performed upon a five-infeed-bin collating machine, for different concrete cases;

FIG. 12 tabulates, for a five-infeed-bin collating machine of conventional operation, how many collating operations and of what types are needed for particular jobs, and what infeed bins to use for each such collating operation; and FIG. 13 is a tabulation which defines what occurs during collating operations performed upon a two-infeed-bin collating machine, for a concrete case.

DESCRIPTION OF THE PREFERRED EMBODIMENTS

In this description, the word "bin" is used for concreteness, but is to be broadly understood; in the art the term "station" is customarily employed.

For the purpose of explanation, I discuss a machine for collating punched cards. Also, it will be assumed initially that the collating machine has five infeed bins; other possibilities are of course comprehended, and are discussed further below.

Figure 1:
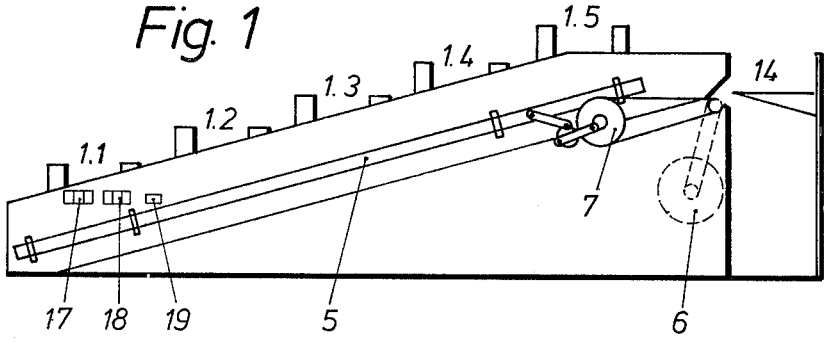
FIG. 1 depicts the external appearance of a five-infeed-bin collating machine.

The external appearance of such a five-infeed-bin collating machine, adapted to collate punched cards, is shown in FIG. 1.

The machine operates as follows:

The cards to be collated are laid (in accordance with a scheme explained below) into the infeed bins 1.1 to 1.5; it may happen that some infeed bins are not utilized.

Each infeed bin (see infeed bin 1.1 in FIGS. 3 and 4) is provided with a card-feeding knife 2. Knife 2 is caused to perform swinging movements. Knife 2 is connected via a linkage element 3 and a rocker arm 4 to a longitudinally shifted rod 5. The longitudinal shifting movement of rod 5 is derived from a drive motor 6 (see FIG. 1) by means of a cam arrangement 7. Each time the card-feeding knife 2 thusly moves, it pushes the bottonmost card 8 in the bin out of the bin, through an exit slot 9. As the expelled card emerges, it enters between a pair of transport rollers 10.1 travels over a guide element 11, is transported through a further pair of transport rollers 10.2, and is then deposited onto a conveyor belt 12. The transport rollers and conveyor belt are likewise driven by motor 6.

The transport-roller pairs 10.1 and 10.2 are driven by motor 6 through the intermediary of a belt 13. The transmission ratio employed to drive the transport rollers is such that the speed at which the transport rollers 10.1, 102 pull the card out of the bin 1.1 is five times the speed at which the card-feeding knife pushes the card out through exit slot 9 towards the transport-roller pair 10.1. The conveyor belt 12 is likewise driven at five times the card-expelling speed. Cards are expelled from the five bins 1.1 to 1.5 in unison. These speeds assure that, when five cards (one from each bin) are simultaneoulsy deposited onto belt 12, the card from the bin 1.1.(i.e., the bin farthest from the outfeed bin 14 shown in FIG. 1) will already have passed the turn-around point 12.1 (FIG. 5) of the belt 12, before the next such group of five cards are expelled from the bins 1.1 to 1.5 and deposited onto belt 12.

Figure 3:
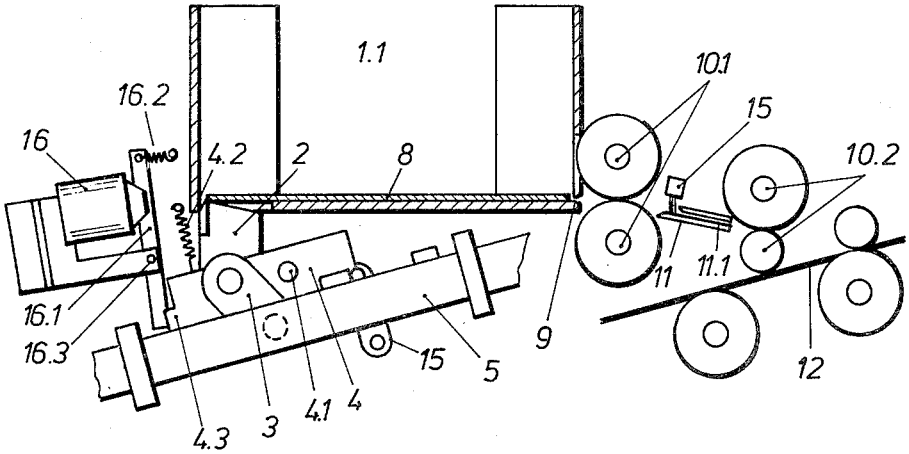
FIG. 3 is an enlarged-scale view of the infeed bin 1.1 of the five-infeed-bin machine of FIG. 1.
Figure 4:
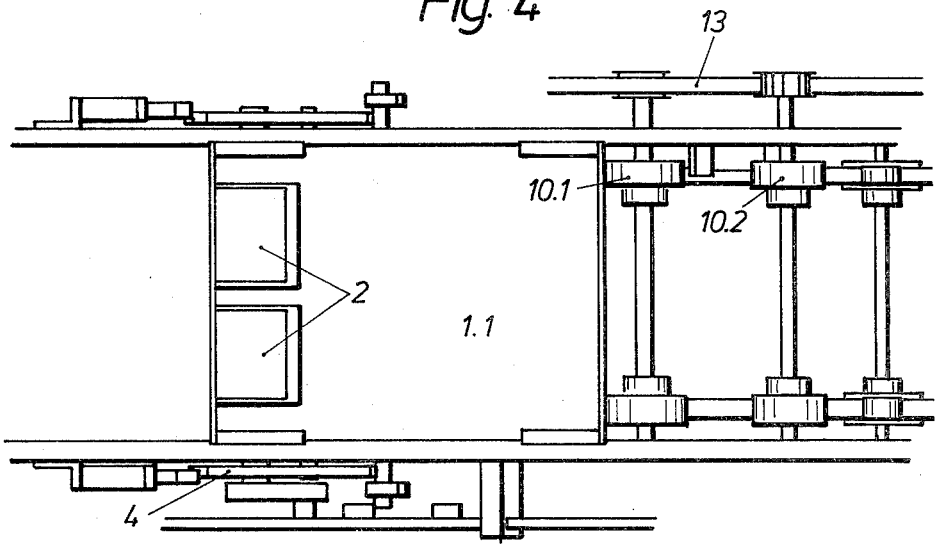
FIG. 4 is a top view looking down on the structure shown in FIG. 3.
Figures 7A, 7B:
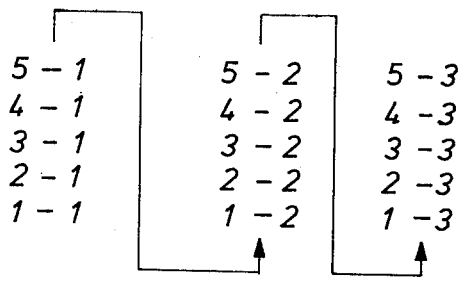

The rocker arm 4 is pivotally mounted on a bolt 4.1 (FIG. 3). When the longitudinally reciprocated rod 5 performs its return (non-feeding) stroke, a second rocker arm 15 tilts the card-feeding knife 2 counterclockwise, against the biasing force of tension spring 4.2, to a position such that as the knife 2 performs its return (non-feeding) movement the knife 2 travels alongside and below but not in contact with the bottommost card in the bin, so as not to damage this next card to be fed.

For reasons explained below, during one card-feeding cycle, it may be necessary that a card not be pushed out of a specific one, of specific ones, of the five bins, whereas a card is to be pushed out of each one of the remaining bins. When this is to occur, then (by means described below), the electromagnet 16 (FIG. 3) associated with the specific non-feeding bin is energized; each bin is provided with such an electromagnet. The electromagnet 16 is energized at a time when its associated card-feeding knife 2 is at its most forwardly advanced position. The armature 16.1 of the electromagnet 16 is pulled in, against the resisting force of a tension spring 16.2, and accordingly turns counterclockwise about a mounting pin 16.3. As a result, the lower part of armature 16.1 moves rightward and latches in above a projection 4.3 of the rocker arm 4; it will be understood that, at this time, in the manner already described, knife 2 will be tipped downward, and therefore at this time the lower part of armature 16.1 can latch-in or arrest the knife 2 in its tipped-downwardposition. Thereafter, for so long as the electromagnet 16 remains energized, the card-feeding knife 2 will be located spaced below the bottommost card of the card-stack in its bin, and therefore can feed no cards.

Each infeed bin includes an electrically conductive sensing element 15, which is in electrically conductive engagement with part 11.1 of the guide element 11, i.e., in the absence of a card therebetween. Each time a card enters between sensing element 15 and guide element 11, this electrically conductive engagement is interrupted, and in per se conventional manner results in the generation of a counting pulse, which is applied to the input of a (non-illustrated) card counter. The card counter cooperates with a selector switch 17 (FIG 1), which latter is used to preset any desired multi-digit number within a range of such numbers.

When the count on such card counter reaches a number equal to the number preset on selector switch 17, a pulse is generated (e.g., at the output of a comparator having inputs connected to switch 17 and the counter). This pulse, via a power amplifier, energizes the electromagnet 16, and thereby suppresses card-feeding operation. Additionally, this pulse is used to reset the counter, so that the counting operation can begin anew.

Each infeed bin 1.1 to 1.5 can be provided with a second electronic counter, receiving the same counting pulses from sensing element 15 as does the above-mentioned first counter, and cooperating with a second selector swtich 18. The first and second counters and first and second selector switches 17, 18 are so interconnected that the first counter with its selector switch cannot begin to count, until the second counter has reached or exceeded the number preset on its associated selector switch 18. Additionally provided, is a push-button switch 19, which when pressed resets the first and second counters to zero.

In FIG. 1, the two selector switches 17, 18 and the reset switch 19 are shown for only the infeed bin 1.1. However, it is to be understood that each one of the five infeed bins is provided with such switches 17, 18, 19, and of course with the two counters associated with switches 17 and 18.

Figure 2:
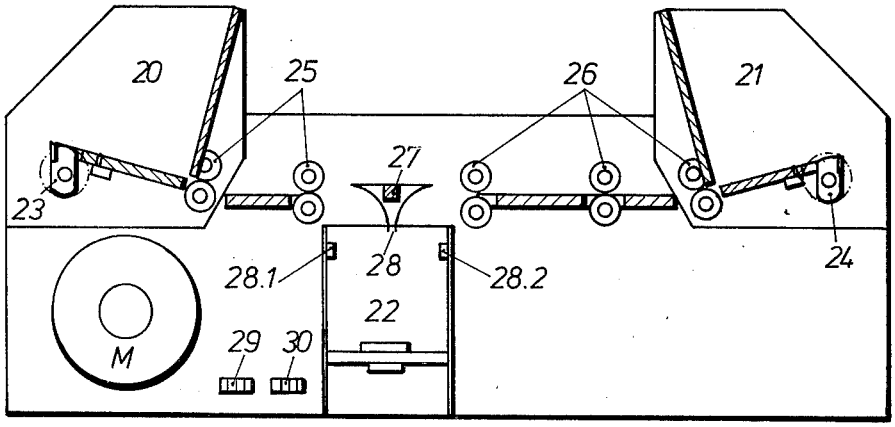
FIG. 2 depicts a two-infeed-bin collating machine.

Before explaining, in detail, the collating scheme per se, reference is made to a second, and particularly advantageous embodiment of a collating machine, shown in FIG. 2. This collating machine has only two infeed bins, the minimum number of infeed bins needed for practicing the collating technique of the present invention.

Mainly, the collating machine of FIG. 2 comprises the two infeed bins 20 and 21, and one outfeed bin 22. Cards are pushed out, one by one, from the infeed bins, by means of conventional rotating card-feeding knives 23, 24. The cards expelled from infeed bin 20 are transported to outfeed bin 22 by means of transport rollers 25; i.e., no belts are used. Likewise, the cards expelled from infeed bin 21 are transported to outfeed bin 22 by means of transport rollers 26.

The scheme in accordance with which the cards are fed to the outfeed bin 22 will be explained further below.

A motor M drives the card-feeding knives 23, 24 and the transport rollers 25, 26.

Located above the outfeed bin 22 is a deflector 27, which deflects cards coming from the infeed bins 20, 21 into the outfeed bin.

The manner in which sets are formed, using the two-infeed-bin collating machine of FIG. 2, includes the following:

One half the cards to be collated are laid into the infeed bin 20, and the other half into the infeed bin 21; i.e., at the start, the number of cards in infeed bin 20 equals that in infeed bin 21. The manner in which the cards to be collated are initially divided between the two infeed bins will be explained further below. The card-feeding knives 23, 24 act in unison, to simultaneously expel two cards at a time, i.e., one from each infeed bin. The two expelled cards then travel towards each other. The cards from both the left bin 20 as well as those from the right bin 21 are conveyed to and deposited in the outfeed bin 22.

However, the outfeed bin 22 is located leftwards of the center-line of the machine. When two cards are simultaneously expelled from the two infeed bins 20, 21, i.e., one from each bin, the one from left bin 20 reaches the outfeed bin 22 sooner than does the one from right bin 21, by an amount of time equal to appoximately one half the duration of a card-feeding cycle. In this way, the outfeed bin 22 receives cards from bins 20 and 21 alternately, i.e., a card from bin 20, then a card from bin 21, then again a card from bin 20, and so forth. The first card received from outfeed bin 22 is, accordingly, always a card from infeed bin 20; furthermore, this first card will always be the bottommost card in the stack of cards accumulating in outfeed bin 22.

The collating machine of FIG. 2 is additionally provided with a photoelectric eye 28, comprising a light source 28.1 and a light detector 28.2. The light path of this unit is interrupted, each time a card falls down into the outfeed bin 22, resulting in the generation of a pulse. This pulse is amplified and applied to the counting input of a counter 29. Counter 29 cooperates with a selector switch 30, to stop the collating machine when the count on counter 29 has reached the number preset on selector switch 30, i.e., when outfeed bin 22 has received a number of cards equal to the number preset on selector switch 30. Counter 29 can be manually reset to zero, by means of a (non-illustrated) pushbutton reset switch.

Establishing the Rules

The two, rather simple collating machines just described are both capable of collating in accordance with the present invention. The collating scheme to be followed will now be explained with reference to the tabulations in the drawing. In these tabulations, the numeral before the hyphen represents the number of the original; the numeral after the hyphen represents the number of the copy of that original. The numeral in parentheses represents the number of the infeed bin. Thus, for example, FIG. *7a* is a tabulation consisting of five vertical columns. The numerals (1), (2), (3), (4), (5), one at the top of each vertical column, identify respective ones of five infeed bins. The hyphenated numerals in each column (e.g., 1-3, 1-2, 1-1 in the first vertical column) represent the copies in the associated bin.

Furthermore, the order of the hyphenated numerals in each column, going from the bottom of the column to the top of the column, corresponds to the order of the copies in the bin represented, going from the bottommost copy in the bin to the topmost copy in the bin.

Thus, the tabulation in FIG. *7a* conveys the following information: In bin (1), the bottommost copy 1-1 is a copy of the first original, and specifically the first copy of the first original. The second from the bottommost copy in bin (1) is the second copy of the first original. The uppermost copy in bin (1) is the third copy of the first original. Likewise, in bin (5), the bottommost copy 5-1 is a copy of the fifth original, and in particular the first copy of the fifth original. The second from the bottommost copy in bin (5) is the second copy of the fifth original. The uppermost copy in bin (5) is the third copy of the fifth original. The copies in bin (1) are all copies of the first original; the copies in bin (2) are all copies of the second original; the copies in bin (3) are all copies of the third original; and so forth.

As indicated above, in these tabulations, the numeral after the hyphen is the number of the copy of the original in question; thus 1-3 is the third copy of the first original. If all copies of each single original are physically indistinguishable from one another, then the ultimate collated sets will be physically indistinguishable from each other. However, it may happen that the copies of each single original are provided with, for example, a serial number, or perhaps only the copies of the first original are provided with serial numbers; in either event, then, the ultimate collated sets become physically distinguishable. If such is the case, then it would of course be desirable that the ultimate collated sets be not merely collated, but that the sequence of complete sets correspond to the serial-number sequence. This occurs with the inventive collating technique. When this feature is being considered, the numeral after the hyphen, in these tabulations, can be considered to identify, additionally, the serial number of the set which is to be formed.

Clearly, the arrangement of copies tabulated in FIG. *7a* is the conventional starting condition when collating in the ordinary way with an ordinary collating machine. Here, there are copies of five originals, and in particular three copies of each such original. Bin (1) contains the stack of copies of the first original; bin (2) contains the stack of copies of the second original; and so forth. I.e., there are 5 CP-stacks, each containing 3 CP (3 copies). An ordinary collating machine can, utilizing a single conventional collating operation, convert the 5 CP-stacks of FIG. *7a* into the single stack tabulated in FIG. *7b*. The arrows in FIG. *7b* make clear how the substacks of the single ultimate stack adjoin, one to the next. The single stack of FIG. *7b* consists of three complete sets, one atop the other. The bottommost set is the first set, the next the second set, and the topmost the third set.

Still assuming a five-infeed-bin collating machine, it is apparent that if copies made from more than five originals are to be collated, such a single conventional collating operation cannot be used. In that event, in accordance with the present invention, at least a second collating operation is to be performed. The plural collating operations of the present invention are to be distinguished from the "plural collating operations" of prior-art job-dividing techniques. When the number of originals from which copies have been made exceeds the number of infeed bins available, for example five, it is known to perform plural collating operations, "doing" the copies from five different originals at a time, and then combining the various incomplete sets thusly formed after the plural collating operations, into complete sets. Although this prior-art practice can be characterized as "plural collating operations", it is to be understood that when that expression is used relative to the present invention, "plural collating operations" means that copies to be collated pass through the collating machine more than once.

For each of the plural collating operations, the number of infeed bins utilized for e.g., the second collating operation will not, in general, be equal to the number of infeed bins utilized for the first collating operation. This is explained with respect to FIG. 12.

In the tabulation of FIG. 12, the heading B of the first column indicates the number of originals from which copies have been made. The Roman numerals heading the right four columns indicate first (I), second (II), third (III) and fourth (IV) collating operations. As before, the numerals in parentheses identify infeed bins. The X's indicate which infeed bins are used during which collating operations, for the given number of originals from which copies have been made. Thus, for example, lines 2 to 5 of FIG. 12 indicate that, when the number of originals from which copies were made equals five or less, the number of infeed bins utilized is equal to such number, and only one collating operation is needed; i.e., this corresponds conventional collating. Line 18, for example, of FIG. 12 indicates that, when copies made from 18 different originals are to be collated, the first three bins (1), (2) and (3) are used during the first collating operation; the first three bins (1), (2) and (3) are again used during the second collating operation; and only bins (1) and (2) during the third collating operation.

A concrete example will now be discussed: Assume that three copies have been made from each one of 12 different originals. Line 12 in FIG. 12 indicates that, for the first collating operation, four infeed bins are used; and that, after the first collating operation is completed, the contents of the outfeed bin are then reintroduced into the machine, for performance of the second collating operation, but this time using only three infeed bins. Because columns III and IV are blank, at line 12 of FIG. 12, this indicates that the second (II) collating operation will have already produced the desired sets of copies.

This concrete example is tabulated in FIGS. 8*a* to 8*c*. Three copies have been made from each one of 12 different originals (a total of 36 sheets); thus, one starts with 12 CP-stacks, each containing 3 CP. As shown in FIG. 8*a*, the first CP-stack is laid into the bottom of infeed bin (1), the second CP-stack above it, the third CP-stack at the top of the bin; the fourth CP-stack is laid into the bottom of infeed bin (2), the fifth CP-stack above it, the sixth CP-stack at the top of bin (2); and so forth. The first (I) collating operation is then performed.

FIG. 8*b* shows what has been achieved at the end of the first collating operation, and also the starting situation for the second collating operation. FIG. 8*b* is a tabulation consisting of three vertical columns of hyphenated numerals. Upon completion of the first collating operation, the sheets tabulated in the left column are those at the bottom of the outfeed bin; the sheets tabulated in the right column are at the top of the outfeed bin. I.e., it will be clear that the bottommost sheet (1-1) in the outfeed bin was the bottommost sheet in first infeed bin (1), and that the topmost sheet (12-3) in the outfeed bin was the topmost sheet of the last infeed bin (4).

Simultaneously, the three vertical columns in FIG. 8*b* show how the 36-sheet stack in the outfeed bin (collected at the end of the first collating operation) is to be split up and reintroduced into infeed bins, for the second collating operation. In particular, the stack in the outfeed bin is split up into thirds: the bottommost twelve sheets (left column in FIG. 8*b*) go into bin (1); the middle twelve sheets (middle column in FIG. 8*b*) go into bin (2); the topmost twelve sheets (right column in FIG. 8*b*) go into bin (3).

The arrows (having brackets at their tails) extending from FIG. 8*a* to FIG. 8*b* help the reader to visualize the abstract change of relationships occurring during the first (I) collating operation. I.e., the four CP-stacks which, at the start of the first collating operation, were the bottommost stacks in the four infeed bins, are, for the start of the second collating operation, all located in the first infeed bin (1); and so forth.

FIG. 8*c* tabulates the contents of the outfeed bin, at the end of the second collating operation. It will be seen that the single 36-sheet stack in the outfeed bin consists of the desired three sets, each set containing 12 sheets, the first set at the bottom, the second set atop the latter, and the third set at the very top.

A little thought will reveal that the number of bins utilized could be reversed. Instead of using four bins for the first collating operation and three bins for the second, three bins could be used for the first collating operation and four bins for the second. The bracket-tailed arrows connecting FIGS. 8*a* and 8*b*, just referred to, should help make this clear. What is important is the product 12 (i.e., 12 sheets per set). $3\times4=4\times3=12$.

Likewise, from what has just been explained, the reader will appreciate that, with a 5-infeed-bin machine, the maximum number of sheets which the sets to be formed can contain, if only two collating operations are used, is $5\times5=25$. I.e., in such a situation, the sets to be formed cannot consist of more than 25 sheets each.

For this 5-infeed-bin machine, if copies made from more than 25 originals are to be collated in this way, at least three collating operations are needed. FIGS. 9*a* to 9*d* tabulate a concrete example: 3 copies have been made from each one of 60 different originals, and so a total of 180 sheets are to be collated. FIG. 9*a* shows how the sheets are laid into the five bins, for the first collating operation. After the first collating operation is performed, the single stack of 180 sheets in the outfeed bin is broken down into fourths, and each fourth placed into one infeed bin, for the second collating oepration. FIG. 9*b* shows what the four infeed bins contain, at the start of the second collating operation. Bin (1) receives the bottommost 45 sheets from the outfeed bin; bin (4) receives the topmost 45 sheets from the outfeed bin; and so forth.

The second collating operation is then performed. Thereafter, the 180 sheets in the outfeed bin are broken down into thirds, the bottom 60 sheets then going into bin (1), the middle 60 sheets into bin (2), and the top 60 sheets into bin (3), for the third collating operation. FIG. 9*c* depicts the contents of bins (1) to (3) at the start of the third collating operation. After the third collating operation is performed, the outfeed bin contains the three desired sets of 60 copies each. As shown in FIG. 9*d*, the first set is the bottommost set in the outfeed bin; the second set is above it; and the third set is the topmost set in the outfeed bin.

Here again, the following is to be noted: five bins, then four bins, then three bins were utilized, for the first, second and third collating operations. However, this order is not critical for operativeness. Instead, what is important is that the number of bins utilized for the first collating operation, multiplied by the number used for the second, multiplied by the number utilized for the third, yield the product 60 (60 is the number of sheets which each set to be formed is to contain). It will be clear that, with five available infeed bins, and three collating operations, the sets to be formed cannot contain more than $5\times5\times5=125$ sheets each.

From what has just been explained, one can begin to generalize. If F infeed bins are available, then if one uses only one collating operation, the sets to be formed cannot contain more than F sheets each; if one uses two collating operations the sets to be formed cannot contain more than $F\times F$ sheets each; if one uses three collating operations, the sets to be formed cannot contain more than F×F×F sheets each; and so forth.

It is emphasized that collating in accordance with this scheme, performed on a conventional multi-infeed-bin collating machine, does not require a special program or program control for machine operation. In terms of what the machine "knows" is happening, ordinary collating operations are being performed. However, it is necessary, at the start of the first collating operation, that CP-stacks be properly laid into an appropriate number of infeed bins; likewise, it is necessary, at the start of each subsequent collating operation, to know how to split up the outfeed-bin stack into sub-stacks (e.g., whether into thirds, quarters, fifths) or equivalently to know how many infeed bins should next be utilized.

The perceptive reader will realize that, with the scheme thus far described, it is not yet possible to produce the desired sets by collation, for any arbitrarily presented situation. The number of sets to be formed (i.e., the number of copies per original) per se presents no problem at all. However, the number of originals (i.e., the number of copies which each single set is to contain) may not be suitable for using the scheme thus far described. In particular, to ascertain whether the number of originals permits use of this scheme, the following is determined: Take the number B of originals involved, and resolve this number into its prime-number factors. For example, if the number B of originals involved is 14 originals, 14=1×2×7; 1, 2 and 7 are, each one, a prime number. Likewise, if the number B of originals involved is 43 originals, 43=1×43. If, after this is done, any of the prime-number factors is greater than the number of available infeed bins (e.g., five infeed bins), the scheme thus far described cannot per se be used.

Thus, for these particular values of B, the question arises what to do.

One solution, which does not require unconventional operation of the collating machine, is to resort to something similar to the job-dividing technique of the prior art. For example, if the number B of originals is 11 originals, the prime-number factors of 11 are 1 and 11, and 11 is greater than the number of infeed bins available (five). Thus, the following can be done: Take the first five CP-stacks (each CP-stack contains all the copies of just one original), and perform a first collating operation, after laying each one of the five CP-stacks into a respective one of the five infeed bins. Upon completion of the first collating operation, the outfeed bin contains a stack of incomplete sets (each set containing copies of only the first five originals). These are then, for example, removed and laid aside.

Of course, what has been performed thus far is indistinguishable from piror-art job-dividing techniques. Then, take the remaining 6 CP-stacks (each CP-stack contains all the copies of just one original), and then collate these. Of course, 6 exceeds the number of available infeed bins (five) and therefore a conventional single collating operation cannot be performed. However, the prime-number factors of 6 are 2 and 3 (ignoring unity), and both of these are lower than the number of available bins. Thus, with respect to these 6 remaining CP-stacks, collation in accordance with the scheme described above can be performed, i.e., using two collating operations. This is done, and then the outfeed bin contains a stack consisting of incomplete sets, each incomplete set containing copies of the 6th through 11th original. These incomplete sets are then combined with the earlier-formed incomplete sets, to form complete sets.

In the example just given (B=11=5+6), something similar to the job-dividing technique of the prior art is, accordingly, utilized. The first 5 CP-stacks are dealt with as in prior-art job-dividing techniques, whereas the remaining 6 CP-stacks are dealt with in accordance with the novel scheme described above. Accordingly, as a whole, the collation of the copies of the 11 originals is, so to speak, a hybrid technique, but still to be distinguished from conventional job-dividing techniques.

Now that this has been explained, attention is directed back to FIG. 12, for a fuller explanation of what FIG. 12 signifies. The second vertical column in FIG. 12 has the heading B+B; some horizontal lines in FIG. 12 have entries in the B+B column, and others do not. It will be seen that all B numbers in the leftmost column which have no entry in the B+B column can be resolved into prime-number factors none of which is greater than the available number of infeed bins (five). In contrast, all B numbers in the leftmost column which do have an entry in the B+B column include a prime-number factor greater than five.

The entries in the B+B column indicate, for each such B number, how the CP-stacks are to be split up. In the example just described, B=11 =5+6. For the B=11 horizontal line of the tabulation, the first (I) collating operation is thus performed upon only 5 of the 11 CP-stacks. Then, the remaining 6 CP-stacks are collated, in accordance with the inventive scheme described above, in two further collating operation, i.e., a second (II) collating operation followed by a third (III) collating operation.

Thus, after job-division, one group of CP-stacks can be collated in a way which would be the same as with prior-art job-division techniques, whereas the remaining stacks can be collated in the inventive manner, using two collating operations for these remaining stacks. For B=7=5+2, neither 5 nor 2 is greater than the number of infeed bins, and so here the job-division technique is, in effect, the same as in the prior art. Again, for B=11=5+6, 5 is not greater than the number of infeed bins, but 6 is, and so the job-division technique constitutes, so to speak, a hybrid of prior-art collation and inventive collation. For B=19=9+10, both 9 and 10 are greater than the number of infeed bins, and thus, although a job-division technique is employed, both the first 9 CP-stacks, and thereafter the remaining 10 CP-stacks, are collated in accordance with the novel technique described above.

Now, the meaning of FIG. 12 has been fully explained.

It is possible to avoid the job-dividing technique just explained (in which not all copies pass through the collating machine during one collating operation), by laying the CP-stacks into the infeed bins and controlling the operation of the collating machine in an unconventional way. When this is done, it becomes possible to collate in the desired manner, no matter what number of copies each set to be formed contains.

This procedure can be stated as follows: For up to 25 CP-stacks (up to 25 originals), and for the first collating operation, the first through fifth CP-stacks go into bin (1), the 6th through 10th CP-stacks into bin (2), the 11th through 15th CP-stacks into bin (3), etc. When proceeding in this way, bins for which no CP-stacks are present, simply remain empty. Also, it can happen that one bin (i.e., the last of those utilized) although not empty will contain fewer copies than the other bins utilized.

Figures 10A, 10C:
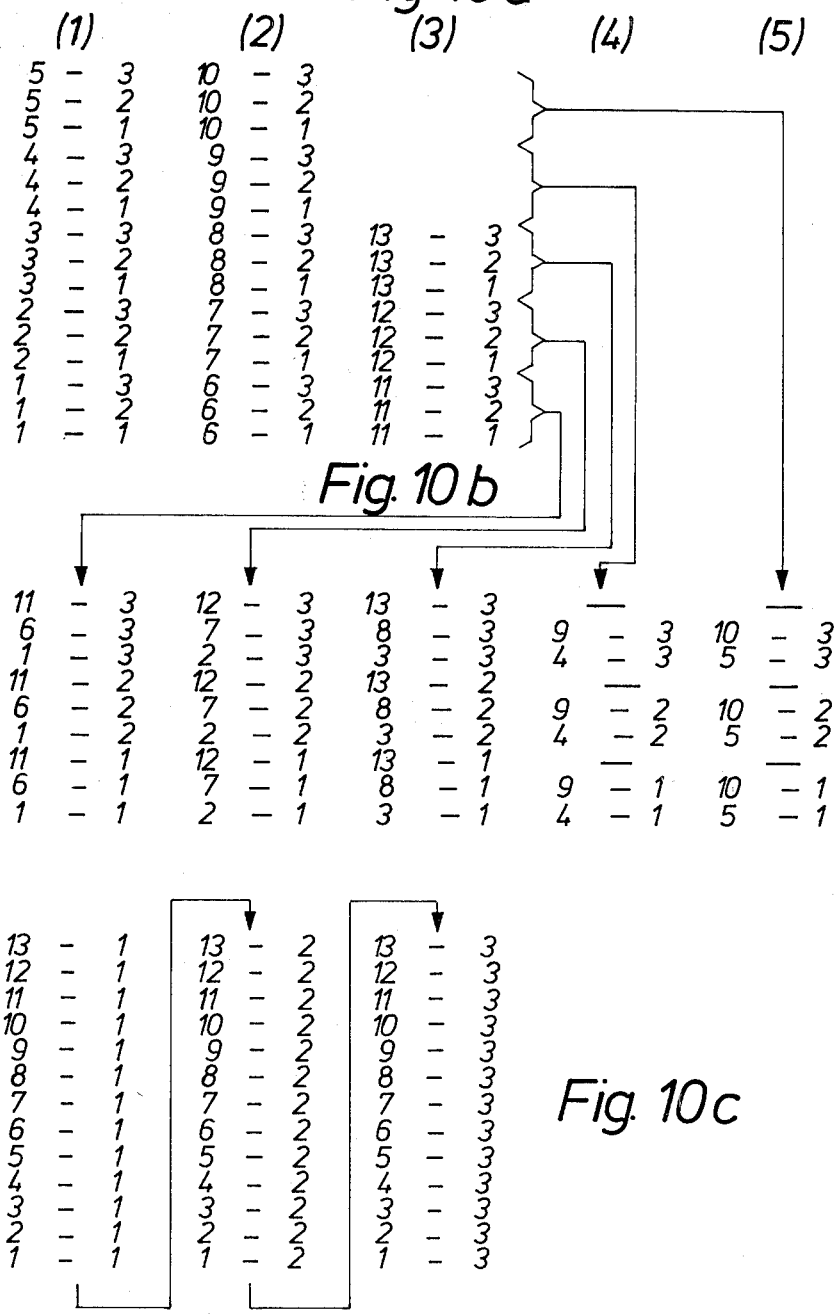

This procedure will be explained, with respect to FIGS. 10*a* to 10*c*, for the formation of 3 sets each set containing 13 copies.

At the start of the first collating operation, bin (1) contains the 1st through 5th CP-stacks, laid one atop the other; bin (2) contains the 6th through 10th CP-stacks; bin (3) contains the 11th through 13th CP-stacks. After the first collating operation is finished, the stack in the outfeed bin is as shown in FIG. 10*b*; as explained above with respect to corresponding Figures, it is to be understood that, in the outfeed bin, the leftmost vertical column represents the sheets at the bottom of the outfeed bin, and the rightmost vertical column the sheets at the top of the outfeed bin. The stack is then removed from the outfeed bin, separated into five parts (shown in the five vertical columns in FIG. 10*b*), and the five parts are laid into the five infeed bins, i.e., as shown in FIG. 10*b*, in preparation for the second collating operation.

It is to be noted that, at the start of the second collating operation, bins (4) and (5) contain fewer copies than bins (1), (2) and (3). The dashes in the two rightmost columns in FIG. 10*b* of course do not correspond to anything physically present in bins (4) and (5), and are provided to facilitate visualization. These dashes indicate that, when the pushing-out of cards from bins (4) and (5) reaches the "places" containing the dashes, a card-feeding operation is to be skipped at these bins; this is explained further below. As a result of this controlled skipping of card-feeding operations at bins (4) and (5), when the second collating operation is finished the outfeed bin will actually contain the three desired sets, tabulated in FIG. 10*c*.

If the number B of originals is between 26 and 125, inclusive, this requires three collating operations. For the first collating operation, the 1st through 25th CP-stacks are laid, one atop the other, in bin (1); the 26th through 50th CP-stacks are laid into bin (2); the 51st through 75th CP-stacks are laid into bin (3); and so forth. FIGS. 11*a* and 11*d* illustrate the case of three copies made from each one of 63 originals. Thus, with only 63 CP-stacks, only bins (1) to (3) are utilized. Bin (3) contains fewer copies than bins (1) and (2). Bins (4) and (5) are entirely empty. The contents of bins (1) to (3), at the start of the first collating operation, are tabulated in FIG. 11*a*. The first collating operation is then performed, and the stack in the outfeed bin is split into five parts (not all containing the same number of copies) and then laid into the five infeed bins, as tabulated in FIG. 11*b*, in preparation for the second collating operation. As before, the dashes in the right three columns in FIG. 11*b* do not represent anything physically present in these infeed bins, and instead represent the "places" at which card-feeding operations are to be skipped, during performance of the second collating operation. When the second collating operation begins, the skipping of card-feeding operations at bins (4) and (5) immediately commences in a regular manner; i.e., at these bins, two cards are fed, and then during the next card-feeding cycle card-feeding operation is skipped, and then two cards are fed again, etc. At bin (3), until after a certain number of card-feeding cycles have passed, there is no skipping of card-feeding operations at all; after that, card-feeding operations are skipped in the same regular manner as at bins (4) and (5), i.e., feed two, skip one. The number of card-feeding cycles which must pass, before the regular skipping of card-feeding operations at bin (3) commences, depends upon both the number of sets to be formed and the number of copies which each set is to contain.

The second collating operation is then actually performed, and then the stack in the outfeed bin is split into five sub-stacks (going in the bottom-to-top direction), and these five sub-stacks are then laid into the five infeed bins (going in the direction from bin (1) to bin (5)), so that, at the start of the third collating operation, the contents of the five infeed bins are as shown in FIG. 11*c*. Then, the third collating operation is actually performed, and the stack formed in the outfeed bin consists of the three desired sets, each containing 63 sheets, as tabulated in FIG. 11*d*.

After the last collating operation, when the stack in the outfeed bin is to be separated into individual sets, such separation is facilitated by the use of separating cards. Such separating cards have the same general format as the copies per se, but are distinguishable with respect to some characteristic, e.g., color. The number of separating cards utilized is, of course, equal to the number of copies per original, i.e., equal to the number of sets to be formed. At the start of the first collating operation, the separating cards are handled as being the first CP-stack, and are laid into the bottom of bin (1). After the last collating operation, the first sheet in each set is a separating card, facilitating separation.

At this point, it ought to be repeated that the number of copies per original, and equivalently the number of sets to be formed, has no problematic effect upon the procedure to be followed.

As already explained, the number of available infeed bins is not of decisive importance, relative to being able to perform the inventive procedure. However, at least two infeed bins must be present; this is the minimum. It is believed appropriate, at this point, to dwell for a while on the two-bin situation.

The minimal case is where only two infeed bins are present and the total number of originals from which copies were made is two (although the number of copies per original can be arbitrarily high, because irrelevant). Then, the number of sets to be formed is equal to the number of CP per original. In this minimal case, each finished set will consist of two copies. Accordingly, the desired sets can be formed using two infeed bins and performing only one collating operation, from two CP-stacks containing arbitrarily high but equal numbers of copies, or $2\times2=4$ copies in 2 runthroughs or $2\times2\times2=8$ copies in 3 runthroughs etc.

Assume that 3 CP of each one of 8 originals are to be collated to form 3 sets. The 8 CP-stacks from which one starts are tabulated in FIG. 13*a*. Clearly, the goal is to convert these stacks into three finished sets, tabulated in FIG. 13*b*. For each collating operation to be performed, one divides the stack containing all copies into two halves, each of which is then laid into a respective one of the two infeed bins. When preparing for the first collating operation, this is relatively easy to do, because the copies are present in the form of simple CP-stacks; the 1st through 4th CP-stacks are laid into one infeed bin, and the 5th through 8th CP-stacks are laid into the other infeed bin. FIG. 13*c* shows the contents of the two infeed bins at the start of the first collating operation, and the lower column at the middle of FIG. 13*c* tabulates the contents of the outfeed bin at the end of the first collating operation.

Now, the cards in the outfeed bin are to be divided into 2 equal stacks, to be placed into the infeed bins for the second collating operation. To do this, the stack in the outfeed bin is split into two equal substacks, at the location shown by the dashed line in FIG. 13*c*. The separating location is, very simply, the midpoint of the outfeed-bin stack. This location can readily be ascertained during the course of the first collating operation. Because 3 CP have been made from each of 8 originals, the total number of copies is $8\times 8$ CP$=24$ CP. $\frac{1}{2}$ of those is 12 CP. Accordingly, a selector switch can be preset to 12, previous to commencement of the first collating operation. Then, during the course of the first collating operation, a counter in the outfeed bin counts the incoming cards. When the count on this counter reaches the count on the selector switch, collating-machine operation is interrupted. Preferably, the operator then removes this first substack and lays it into bin (1) of a separate sorting rack; alternatively, when collating-operation is thusly interrupted, the operator inserts atop the first substack a dividing card, which is for example longer than the copies in the substack, i.e., to mark the point of division; of course, such dividing card will be removed before laying the copies into the infeed bins for the second collating operation.

For the second collating operation, the two substacks just mentioned are laid into bins (1) and (2) as shown in FIG. 13*d*. The bottom column at the middle of FIG. 13*d* tabulates the contents of the outfeed bin upon completion of this second collating operation. In FIG. 13*d*, again, a dashed line marks the point of division between the two outfeed-bin substacks, each of which two goes into a respective one of the two infeed bins, for the third collating operation. Again, this point can be ascertained using a preset selector switch and a counter, as just explained.

FIG. 13*e* shows the contents of the two infeed bins at the start of the third collating operation; the lower column in the middle of FIG. 13*e* tabulates the contents of the outfeed bin upon completion of the third collating operation. It will be seen that the outfeed bin, at this point, now actually contains the desired sets tabulated in FIG. 13*b* earlier.

The two-infeed-bin technique just described can be used wherenever the number B of originals from which copies were made is a power-of-2, i.e., 2, 4, 8, 16, 32, 64, 128, etc.

Of course, most numbers are between adjoining powers-of-2. When the number B of originals has such a value, one proceeds as follows: Assume that 3 CP have been made from each one of 63 originals, and that one is accordingly to form 3 sets each containing 63 copies. One could add to the initial 63 CP-stacks a 64th or "dummy CP-stack", and then perform the job using 6 collating operations ($2^6=64$). If one wishes to reduce the number of runthroughs experienced by each copy from 6 to 5, e.g., in order to reduce physical wear on the copies, this can be done, by still using the "dummy CP-stack", but also using a job-dividing technique to break the copies down into two lots, i.e., one lot constituted by the 1st through 32nd CP-stacks, the other by the 33rd through 64th CP-stacks, and after completion of all collating operations, combining the resulting half-sets. If one wishes, one could divide the job into more than just two lots; in that event, especially if the job is to be divided into several lots, it becomes appropriate to resort to a separate special-purpose runthrough on the machine, i.e., just to count off the copies which are to form each lot, so as not to have to do this manually. Such a count-off can be performed using the already mentioned photoelectric eye in the outfeed bin, and the cooperating counter.

Continuing with the explanation of this concept, assume that 3 CP have been made from each one of 57 originals, and that these copies are to be converted into 3 sets each containing 57 copies. The cards are continually laid into the right infeed bin of FIG. 2. The first lot can contain all copies of 32 of the 57 originals (32 being a power-of-2). Because there are 3 CP per original, the selector switch is preset to $32\times 3=96$. Then, during this first runthrough, when the card counter for the outfeed bin reaches the count 96, the collating machine stops and an indication is generated, signalling that the outfeed bin now contains the copies for the first lot; for example, this is signalled using an indicator light different from the indicator light used to indicate that the machine has stopped because it has run out of copies for collation.

At this point, the 96 cards in the outfeed bin (all copies of the 1st through 32nd originals) are removed, and now constitute the first lot.

The second lot is to contain all copies from a certain number of originals. This number is to be the highest power-of-two possible, for the number or originals still remaining. The number of originals (or CP-stacks) still remaining is $57-32=25$. The highest power-of-2 in 25 is 16. Accordingly, the second lot is to contain all copies made from the next 16 originals, i.e., is to consist of the 33rd through 48th CP-stacks. The total number of copies in this second lot will be $16\times 3=48$. Accordingly, the selector switch is preset to 48, and the runthrough continues. After these next 48 cards have been deposited into the outfeed bin, the machine again stops, a signal is generated for the operator, and the operator removes this second lot from the outfeed bin. The second lot is, for example, laid alongside the first lot, on a nearby sorting rack. The total number of copies present for the whole job need not necessarily be placed into the one infeed bin being used all at the same time; they can be laid in little-by-little or batchwise, if convenient.

After forming the first and second lots, it is now the third lot which is to be formed. The number of CP-stacks still in the infeed bin (i.e., not yet forming part of a lot) is 9 CP-stacks. The highest power-of-2 in 9 is 8. Therefore, of the remaining 9 CP-stacks, 8 CP-stacks are to constitute the third lot. The copies of the third lot are counted off in the manner just described, the third lot is then removed from the outfeed bin and laid aside on the nearby sorting rack.

Thus, so far, $32+16+8=56$ CP-stacks, of the total of 57 CP-stacks constituting the whole job, have been split into 3 lots, and one CP-stack containing 3 copies is left over. Clearly, no matter what the number B of originals (or equivalently, CP-stacks) involved, this number will be either even or odd, and therefore can either be converted into a sum of powers-of-2 without a remainder, or else into a sum of powers-of-2 plus a remainder of 1.

In either event, each lot is now subjected to as many collating operations as needed to form the associated incomplete sets. The first lot (32 CP-stacks) requires 5 collating operations ($2^5=32$). The second lot (16 CP-stacks) requires 4 collating operations ($2^4=16$). The third lot (8 CP-stacks) requires 3 collating operations ($2^3=8$). The last lot or remainder (one CP-stack consisting of 3 copies) is left over.

Because it is desired to form three sets each containing 57 CP, as one goes along performing these collating operations, the incomplete sets formed are laid onto the three stations of the nearby sorting rack in the following way:

After collating the lots in accordance with the two-infeed-bin scheme described above, the following will have been produced: From the first lot, 3 incomplete sets, each containing one copy of each one of originals No. 1 to No. 32. These 3 incomplete sets are laid, side by side, onto the nearby sorting rack. From the second lot, 3 incomplete sets, each containing one copy of each one of originals No. 33 through No. 48. These 3 incomplete sets are laid on top of respective ones of the 3 incomplete sets already laid on the sorting rack. The same is done for the 3 incomplete sets made from the third lot. Accordingly, the sorting rack now has 3 incomplete sets, each set containing one copy from each one of originals No. 1 through 56, with the copy from original 56 being the topmost copy on each of these three incomplete sets. All that remains is the left-over 57th CP-stack, consisting of 3 copies made from the 57th original. These are sorted onto the three incomplete sets, by hand. As already explained, such a left-over CP-stack will be present, only if the total number of CP-stacks (originals) involved was an odd number.

In the examples given above, to avoid large numbers which might be distracting, it has been assumed that there are only 3 copies per original (only 3 CP in each CP-stack), but relatively large numbers of originals have been discussed. It should be self-evident that if the number of CP-stacks (originals) is relatively low, this only simplifies the work to be done, because fewer collating runthroughs are needed. Of course, the number of copies per original can be arbitrarily high, without increasing the total number of collating runthroughs needed.

By always choosing for the number of CP-stacks in one lot the highest possible power-of-2, the number of incomplete sets to be manipulated at the nearby sorting rack is minimized, but the number of collating runthroughs needed is maximized. If, for example, one chooses for the number of CP-stacks in one lot not the highest possible power-of-2, but instead half that number, this increases the number of incomplete sets later to be manipulated at the sorting rack, but decreases the number of collating runthroughs needed for the whole job. The operator, if he wishes, can compromise between these two extremes, depending upon the job involved, to reduce the maximum number of times that a copy must pass through the collating machine during the course of the whole job.

Here, a few comments are in order, concerning comparative set-forming efficiency of the differing versions of the inventive procedure discussed above. When making these comparisons, no attention is initially paid to the count-off work done during the first count-off runthrough, i.e., which is performed merely to divide the CP-stacks into lots, because this amount of work is determined by the total number of copies involved; the count-off work is substantially the same for a given number of total copies, irrespective of the number of lots into which the CP-stacks are to be divided.

For example, we return to the concrete instance of 57 CP-stacks (57 originals). If the number of copies per original is quite high, e.g., 100 copies per original, then it is positively preferable to break up the 57 CP-stacks into lots of only 8 CP-stacks each, i.e., to deliberately avoid using for the first lot the first 32 CP-stacks (the highest power-of-2 in 57). One then works upon 7 lots each consisting of 8 CP-stacks ($7\times8=56$) plus one left-over CP-stack (the remainder) which is to be sorted by hand.

A lot consisting of 8 CP-stacks requires only 3 collating runthroughs ($2^3=8$). The machine-time needed to do work can be expressed in the number of card-feeding cycles performed (simultaneously) at the two infeed bins, hereafter called "card cycles". When the first lot is split into halves, and each half laid into one of the two infeed bins, each bin contains 100 copies of each of 4 originals. Accordingly, the collating runthrough then performed requires 400 card-cycles for completion. Thus, the three collating runthroughs need to finish all machine-performed work done on the first lot requires 1200 card-cycles. And so, for all machine-performed work done for all 8 lots, a total of $8\times1200=9600$ card-cycles of machine-time are required. Thus, if one resists the temptation to form a first lot containing a number of CP-stacks equal to the highest power-of-2 possible, the whole job can be performed using 9600 card-cycles of machine-time.

We now compare to this the number of card-cycles needed, if each lot formed contains a number of CP-stacks equal to the highest power-of-2 possible for that lot, i.e., proceeding on the 32-16-8 basis described earlier:

1st lot:
32 originals @ 100 CP=3200 CP
in each infeed bin 1600 CP
5 runthroughs needed ($2^5=32$)
thus, for 1st lot, $5\times1600=8000$ card-cycles 2nd lot:
16 originals @ 100 CP=1600 CP
in each infeed bin 800 CP
4 runthroughs needed ($2^4=16$)
thus, for 2nd lot, $4\times800=3200$ card-cycles 3rd lot:
8 originals @ 100 CP=800 CP
in each infeed bin 400 CP
3 runthroughs needed ($2^3=8$)
thus, for 3rd lot, $3\times400=1200$ card-cycles Total=8000+3200+1200=12400 card-cycles.

Clearly, dividing into lots on the basis of the highest possible power-of-2 (the 32-16-8 technique) consumes more machine time (expressed in card-cycles) than simply dividing into 7 lots each consisting of 8 CP-stacks. Specifically, the first technique requires 12400−9600=2800 card-cycles more machine-time than the second. This is greater by about 29%. Of course, this increased machine-time will tend to be offset by reduced handling-time (time required for manual combining of incomplete sets to form complete sets). However, even when one fully takes into account the increased handling-time, it is clear that the second technique requires each copy to pass through the collating machine no more than three times (i.e., not including the first count-off runthrough used to divide the CP-stacks into lots).

Now, when one does take into account the machine-time consumed during the count-off runthrough (i.e., which is performed merely to divide the CP-stacks into lots), the comparison changes somewhat: For 56 originals @ 100 CP, $56\times100=5600$ card-cycles are needed, i.e., just for the lot-forming count-off. Thus, considering the absolutely total number of card-cycles needed for the two techniques, the following is to be seen:

(a) with the "8 CP-stack per lot" technique
5600+9600=15200 card-cycles (b) with the "32-16-8" technique 5600+12400=18000 card-cycles In case (b), one still needs 2800 card-cycles more than is needed for case (a). However, because of the greater number of card-cycles when one considers the initial count-off runthrough, the increase of machine time for case (b) is now only 20% relative to case (a).

Thus, when the 2-infeed-bin scheme of the present invention is utilized, it is nevertheless not appropriate to attempt to define the technique in absolute terms. Typically, when an operator practices this technique, he will use either the "8 CP-stack per lot" technique exclusively, or else the "32-16-8" technique exclusively, but more often a hybrid of the two, depending upon the job given him, and in particular depending upon whether the number of CP per original is very high or not, but possibly also with a view towards minimizing the wear on the copies resulting from repeated passage of the copies through the collating machine. In this latter connection, it is of course to be understood that when practicing the "32-16-8" technique, all cards passing through the machine do not pass through an equal number of times. The cards of the first lot, for example, pass through 6 times, those of the second lot 5 times, etc.

From the foregoing, it will be clear that the inventive technique can be practiced in a variety of ways, some of which may include phases of operation similar to conventional prior-art collating operations, e.g., when division of the whole job into lots is performed and one or more of the lots are subjected to a conventional prior-art collating operation. Thus, in order to be able to define what, in these various versions of the inventive technique, is common to them all, and what furthermore distinguishes them from conventional collating operations, some of what has been explained above is now reviewed, with respect to the question of defining the inventive technique.

In the clearest and simplest case (i.e., from the viewpoint of the definition problem), nothing similar to prior-art collating techniques is performed. In these cases, the number of CP-stacks (originals) in the whole collating job is such that, first, no division of the job into subjobs or lots is needed, and second, the number of CP-stacks (originals) in the whole job exceeds the number of infeed bins actually utilized. In the case of the two-infeed-bin technique, if the number of CP-stacks (including one stack of separating cards, if used) is greater than 2, and is furthermore a power-of-2, then the inventive collating scheme can be used in its "purest" form. "Purest" here means that a plurality of collating operations is performed, and that in each single one of the collating operations absolutely all the copies involved in the whole job pass through the collating machine, once per collating operation. In the case of the two-infeed-bin technique, furthermore, the number of infeed bins utilized is the same (two) for each successive collating operation. This "purest" and simplest (for definition) case distinguishes over prior-art collating techniques in a way which is easy to define: In the prior art, when job-dividing techniques are employed to divide the whole job into subjobs or lots, "plural collating operations" (in the broadest sense of that term) are employed; however, in each such collating operation, it is not absolutely all the copies in the whole job that pass through the collating machine per collating operation; instead, each of the "plural collating operations" of such prior-art procedure is practiced upon only a single respective one of the subjobs or lots, not upon the whole number of sheets involved. Likewise, each subjob or lot in such prior-art procedures passes through the collating machine once and only once.

The same sharp definition and clear distinction can be drawn, for example, with the 5-infeed-bin technique of the present invention. When the total number of CP-stacks (originals) involved in the whole job (including one stack of separating cards, if used) is greater than the available number of infeed bins (greater than five), and if furthermore the total number B of CP-stacks can be resolved into prime-number factors none of which is greater than five, then the inventive technique can be practiced in its "pure" form, i.e., without any division of the whole job into subjobs or lots. Instead, a plurality of collating operations is performed; furthermore, absolutely all the copies in the whole job pass through the collating machine, during each such collating operation; additionally, all copies in the whole job pass through the collating machine an equal number of times. Furthermore, although the number of infeed bins utilized in each successive collating operation may change from one collating operation to the next, the number of infeed bins utilized during each collating operation is always lower than the total number of CP-stacks (originals) in the whole job. Thus, in this case likewise, the distinction relative to prior-art procedures is very sharp and clear.

The next, only slightly less "pure" case is where the number B of CP-stacks (originals) in the whole job is very close to but somewhat lower than a number permitting practice of the invention in its "purest" form, and where accordingly one or more "dummy CP-stacks" are used, to increase the total number of CP-stacks in the whole job to such a number. Thus, as shown in lines 23 and 24 of FIG. 12, if the total number of CP-stacks is 23, it may become necessary (i.e., if the skipping technique described earlier is not used) to break the job into two subjobs or lots, one consisting of 8 CP-stacks, the other consisting of 15 CP-stacks; however, by adding to the job one "dummy CP-stack", the total number of CP-stacks involved rises to 24, and this number can be collated using the inventive technique in its purest form. Likewise, when using the 2-infeed-bin machine, if the total number of CP-stacks is, for example, only one or two smaller than an exact power-of-2, then to avoid job-division one or two "dummy CP-stacks" can be added (e.g., additional separating cards), to increase the total number of CP-stacks up to an exact power-of-2, whereupon the inventive technique can again be practiced in its "purest" form. When such "dummy CP-stacks" are employed, the "dummy CP-stacks" become part of the whole job; the collating scheme thus converts into its "purest" form; and the character of the collating scheme, and its distinction relative to prior-art collation, is again exactly as just explained. I.e., plural collating operations are involved; during each collating operation, absolutely all the copies (including "dummy copies") pass through the collating machine; and during each collating operation, the number of infeed bins utilized is smaller than the total number of CP-stacks involved (including one stack of separating cards, if used, and the "dummy CP-stacks"). Thus, this slightly less "pure" case really still exhibits exactly the same distinction relative to prior-art procedures, as does the "purest" case just referred to.

The next, and likewise only slightly less "pure" case is where the total number B of CP-stacks (originals) in the whole job is only somewhat greater than a number permitting the inventive procedure to be practiced in its "purest" form. Thus, for the 5-infeed-bin machine, FIG. 12 indicates that if the total number of CP-stacks involved in the whole job is 21, it may become necessary to resort to a job-dividing technique; however, if one fewer CP-stack were involved (i.e., a total of only 20 CP-stacks), the inventive procedure could be practiced in its purest form. In that case, the operator may choose to "leave out" the last (21st) CP-stack, and then for the remaining 20 CP-stacks perform the inventive procedure in its purest form; after the almost-complete but incomplete sets have been formed, the contents of the last CP-stack are then sorted out onto the almost-complete sets by hand. In cases such as these, the "job" is divided into two subjobs; one subjob is collated in accordance with the "purest" form of the inventive technique; the other subjob is not collated at all, but instead is distributively sorted onto or into the almost-complete sets formed from the first subjob. In cases such as these, the first subjob can be considered "the job"; i.e., with respect to this "job", the inventive collating procedure is practiced in its "purest" form, and with respect to this "job" the distinctions relative to prior-art collating techniques are the sharp ones explained above. I.e., plural collating operations are performed; during each collating operation absolutely all the copies involved in this "job" pass through the collating machine; and during each collating operation, the number of infeed bins utilized is smaller than the number of CP-stacks (originals) involved in this "job". When this "job" (i.e., the first subjob) is finished, the outfeed bin contains almost-complete sets (each one missing only the last copy in the set to be formed); these "almost-complete" sets are to be considered the "complete" sets, for seeing the character of the inventive technique and its distinction relative to conventional prior-art procedures. The same applies to the 2-infeed-bin collating machine. If the total number of CP-stacks (originals) in the whole job is only one higher than an exact power-of-2 ( e.g., is equal to 33), the "extra" CP-stack is "left out", the remaining CP-stacks are subjected to the inventive collating technique in its "purest" form, and then the copies in the "left out" CP-stack are distributively sorted onto or into the "almost-complete" sets, e.g., manually. In all these cases, the character of the present invention is still easy to see, and likewise the distinction relative to conventional prior-art procedures.

The next, still "less pure" case is where a true job-division technique must be utilized, and where the plural subjobs are dealt with separately, each subjob being collated, i.e., actually passing through the collating machine. In some cases, when this is done, then each such subjob is collated in accordance with the "purest" form of the inventive technique. Thus, with the 5-infeed-bin machine, if the total number of CP-stacks (including one stack of separating cards, if used, plus one or more "dummy CP-stacks", if used, minus one or a few CP-stacks which are "left out", if this is done) is 19, then FIG. 12 indicates that the job be broken down into two subjobs, one consisting of 9 CP-stacks, the other consisting of 10 CP-stacks, these two subjobs being collated separate from each other. However, here, both these subjobs can then be collated in accordance with the "purest" version of the inventive technique. Thus, although a job-division technique is employed, the plural collating operations performed upon each subjob are in accordance with the "purest" form of the inventive technique; and the character of the inventive technique, and its distinction relative to conventional prior-art procedures, can be seen with respect to each one of the two subjobs, considered individually. The same case can of course arise with the 2-infeed-bin machine. If the total number of CP-stacks (originals) in the whole job is equal to the sum of two exact powers-of-2, then if the operator wishes he can break the job down into two such subjobs, and each of the two subjobs, considered individually as being "a job", is collated in accordance with the "purest" form of the inventive procedure.

The next-less "pure" case is where the job is broken down into subjobs, each of which is collated separately, with the processing of one or more (but not all) of the subjobs being performed in accordance with conventional prior-art practice, but at least one of the subjobs being collated in accordance with the "purest" version of the inventive technique. For the case of the 5-infeed-bin machine, FIG. 12 indicates than when the total number of CP-stacks (originals) is 21, the job can be broken down into two subjobs, one consisting of 5 CP-stacks, the other consisting of 16 CP-stacks. The collating of the 5-CP-stack first subjob, on a 5-infeed-bin machine, can be performed in a single runthrough, using conventional prior-art collating technique. However, the collating of the 16-CP-stack second subjob, on a 5-infeed-bin machine, can be performed in accordance with the "purest" version of the inventive technique. In that case, the character of the inventive technique, and its distinction relative to conventional prior-art practice, is to be seen in the collation of the 16-CP-stack subjob; i.e., for purposes of defining the job upon which the inventive technique is performed, the 16-CP-stack subjob can be considered "the job".

Of course, there are cases where the inventive technique is not actually to be practiced, in any form. Obviously, if the total number of CP-stacks (originals) in the whole job is not greater than the number of infeed bins available, then conventional prior-art collation is sufficient. Likewise, if the total number of CP-stacks is broken down into subjobs, each of which contains a number of CP-stacks equal to or lower than the number of available infeed bins, then each such subjob can be collated in a single runthrough, using conventional prior-art collation, and the incomplete sets thusly formed then assembled into complete sets. Obviously, in such cases, the inventive technique is not practiced at all. In some cases, of course, it may be desirable to proceed in this way, even though the inventive technique could be practiced with respect to the whole job or with respect to subjobs, e.g., in order to reduce the number of times the copies must pass through the collating machine, or else because the number of CP-stacks and the number of copies per CP-stack involved in the whole job make this realistic.

To review what has been said so far concerning the definition question: Job-division may be unnecessary, because of the number of CP-stacks involved in the actual job (including a stack of separating cards, if used), or because the "job" has been made more processable by the addition of "dummy CP-stacks", or by leaving out one or a few of the last CP-stacks. In these cases, the inventive technique is practiced in its purest form, on such "job"; plural collating operations are involved; during each collating operation, all the copies in such "job" pass through the collating machine; during each collating operation, the number of infeed bins utilized is smaller than the number of CP-stacks in such "job". The character of the inventive technique, and its distinction relative to prior art practice, is then to be seen with respect to such "job". If the actual job is broken down into subjobs, each collated separately, and if at least one of the subjobs is collated in accordance with the inventive technique, then for the purpose of definition the one or more subjobs processed in accordance with the inventive technique can each be considered "a job".

It will be understood that when the total job is broken down into subjobs, then (in principle) to render the subjobs amenable to inventive collation (if not already amenable), the "compensatory" techniques (dummy CP-stacks, leaving out one or a few of the last CP-stacks) may be resorted to. Thus, if a job is broken down into two subjobs, then (in principle) e.g., one "dummy CP-stack" could be added to the first subjob, to render it amenable to inventive collation; and e.g., one CP-stack in the second subjob could be "left out" for later manual distributive sorting, in order to render the second subjob amenable to inventive collation; etc.

In the appended claims, reference is made to a job consisting of M CP-stacks, each containing N copies. For purposes of definition, the meaning of the number N in a particular situation is not problematic; it is the number of copies per original or (equivalently) the number of sets to be formed. However, the meaning of the number M is to be understood in the light of the foregoing explanation of the definition question. Where the total number B of CP-stacks in the whole job (including one stack of separating cards, if used) is such that the job is directly amenable to the "purest" version of the inventive collation technique, and such technique is acutally utilized, then M is simply the number of CP-stacks in the whole job (including the one stack of separating cards, if used). If, to achieve this situation, one or more "dummy CP-stacks" have been added to the "true" job, then M is to be understood to include the "dummy CP-stacks", i.e., M is the number of CP-stacks in the "resultant" job. Likewise, if to achieve a "resultant" or "corrected" job directly amenable to the purest version of the inventive collating technique, one or few of the last CP-stacks in the "true" job are left out, for later manual distributive sorting, then M is the number of CP-stacks in the "resultant" or "corrected" job. If the true job is broken down into subjobs, each collated separately, with or without the addition of "dummy CP-stacks" in one or more of the subjobs, and with or without the "leaving out" of CP-stacks for later manual sorting in one or more of the subjobs, then M refers to the number of CP-stacks involved in a subjob collated in accordance with the inventive technique; and, although the collating of such subjob does not yield "complete" sets, but instead "incomplete" sets, the "incomplete" sets are to be considered "sets", for the purpose of definition.

The definition question, as thus far discussed, also helps to make clear the unitary character of the present invention, i.e., just what is to be found in common in all the different combinations of techniques and "tricks" discussed above. Furthermore, with the combinations of techniques and "tricks" described above, the collating operations can be performed upon a conventional collating machine, and there is no need for a specially-programmable collating machine.

Accordingly, all that remains for discussion is the special control technique for a collating machine described earlier, i.e., involving the skipping of card-feeding operations at certain infeed bins during certain card-feeding cycles. To facilitate an overview of the unitary character of the inventive concept, it is appropriate, first, to see how the card-skipping technique correlates with the other techniques and, second, from that to see how the card-skipping technique is "embraced" by the central concept of the invention.

For this purpose, we return to the concrete example tabulated in FIGS. 11*a* to 11*d*. In that example, there are 63 CP-stacks (originals) and three copies per original. As explained earlier with respect to the this example, if the number of CP-stacks had been 75, then such a job would be directly amenable to the purest form of inventive collation; each infeed bin would receive 25 CP-stacks, and three collating runthroughs would result in the desired complete sets. Thus, when presented with the 63-CP-stack job, one possibility would be to "correct" the job, i.e., render it amenable to the purest version of the inventive collating technique, by adding to the 63 CP-stacks 12 "dummy CP-stacks", thereby converting the "true" job into a "corrected" job involving 75 CP-stacks. Then, after the third collating operation, the desired sets would be present in the outfeed bin, in the correct order, but each set would include at its end 12 "dummy copies" which would then be removed, e.g., by hand.

The use of 12 "dummy CP-stacks" in such a situation is certainly a possibility. However, this would increase the machine-time needed by 12/63, a fairly substantial machine-time increase.

The alert reader will appreciate that the skipping technique used in FIGS. 11*a* to 11*d* is the exact equivalent of using 12 such "dummy CP-stacks". In FIG. 11*a*, bins (1) and (2) each contain 25 CP-stacks, whereas bin (3) contains only 13 CP-stacks. The topmost copy in bin (3), at the start of the first collating operation, is copy 63-3. If 12 "dummy CP-stacks" were utilized, then "dummy copy" 64-1 would be located directly above "true" copy 63-3 in bin (3), and the topmost "dummy copy" in bin (3) would be 75-3. With 12 "dummy CP-stacks" thusly utilized then, during performance of the first collating operation, it is clear that the first of all these "dummy" copies will be received by the outfeed bin, immediately following the receipt of "true" copy 39-1. Having pointed this out, attention is now directed to FIG. 11*b*. It will be seen that the first of the dashes immediately follows (is above) copy 39-1. In other words, in FIG. 11*b* the dashes, explained to represent skipped card-feeding operations, would exactly correspond to the location of "dummy copies", if 12 "dummy CP-stacks" had been used to form a "corrected" job consisting of a total of 75 CP-stacks.

Thus, the reader should now appreciate that the special feed-skipping technique explained above is the exact equivalent of using a sufficient number of "dummy CP-stacks" to form a "corrected" job. Firstly, this will make clear to the reader why the feed-skipping sequence at bins (4) and (5) is occurring, i.e., why two cards are fed at these bins and then one feeding operation skipped. Secondly, this will make clear to the reader why, at bin (3), the regular skipping of feeding operations does not begin until after copy 39-1, and why it thereafter has the feed-two skip-one rhythm. Thirdly, this will make clear to the reader what the skipping rhythm should be in general and at what point it is to start at what bin. Finally, and most importantly, this explanation makes clear exactly why the feed-skipping technique, although it may look very differently from the other described techniques, nevertheless partakes of the same central inventive concept, i.e., because it is a functional equivalent of utilizing a number of "dummy CP-stacks" sufficient to convert the "true" job into a "corrected" job directly amenable to collation in accordance with the inventive scheme.

At this point, the use of inventive technique upon a conventional collating machine, or alternatively upon a specially programmable unconventional collating machine, has been fully defined. To avoid even further complexity in this disclosure, generalities concerning how to proceed are defined with respect to tabulations (e.g., FIG. 12) and with respect to explanatory arithmetic explanations. If an operator is using a conventional collating machine, then, in actual practice, it is quite realistic to expect the operator to work with reference to such tabulations and/or to require him to be able to perform simple arithmetic calculations, i.e., to determine how many subjobs (if any) the total job should be broken down into, whether to use the "trick" involving "dummy CP-stacks", whether to use the "trick" involving the "leaving out" of the last one or few CP-stacks in the job, how many collating operations are needed for each job or subjob, and what bins to use for each collating operation. When one has not practiced these combinations of techniques, they may appear quite complicated and "formidable"; however, after a relatively small amount of actual practice, the "idea" or central concept behind all these techniques becomes very apparent, and reference to tabulations and/or the performance of arithmetic calculations becomes very easy, in a practical sense. Indeed, this approach, because it quickly becomes "easy", is the preferred one.

However, it will be understood that, to spare the operator from all decision-making, the arithmetic calculations could be performed in advance and stored, for example, in a read-only memory (ROM). In that case, the operator would merely, for example, set one knob to the number of CP-stacks in the job, and another knob to the number of copies per CP-stack (i.e., per original). The setting of these two knobs would then address the ROM, and corresponding "guidance" information for the operator would then be read-out and presented, for example, on a "guidance panel". The guidance panel would contain, for example, illuminatable sectors displaying actual operator instructions, such as "BIN (1) CP-STACKS #1-#25", informing the operator that he should lay the first 25 CP-stacks into the bin (1), and so forth. It is emphasized that such possibilities fall within the concept of the present invention. However, such possibilities are not believed worth the expense involved, because "knowing" how to perform the inventive technique is, as already stated, quite easy after a little practice.

Likewise, in the examples described above involving conventional collating machines, it is assumed that the operator manually removes copies from the outfeed bin and reintroduces them into the correct infeed bins of the same machine, for the next collating operation. However, it is self-evident that the infeed bins of a different collating machine could be used. Likewise, if the expense were considered appropriate, automatic means could be provided to take over all such functions. A collating system which does automatically all the work involved, i.e., which feeds outfeed-bin cards back into infeed bins, selects correct infeed bins, adds appropriate numbers of "dummy CP-stacks," etc., although unnecessarily complicated, is embraced within the inventive concepts.

The same comments can be made with respect to the specially controlled collating machine described earlier, i.e., in which card-feeding operations are skipped at certain bins during certain card-feeding cycles. I.e., in principle, all this could be done by an automatic program, it only being necessary that the operator set the number of CP-stacks and copies per CP-stack on selector switches, the program control of the machine then itself determines how many bins to use, collating operations to perform, and so on. Again, however, this would be unnecessarily complicated.

It will be understood that each of the elements described above, or two or more together, may also find a useful application in other types of constructions and procedures differing from the types described above.

While the invention has been illustrated and described as embodied in particular collating procedures and machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from that standpoint of prior art, fairly constitute essential characteristics of the generic or specific aspects of this invention.

What is claimed as new and desired to be protected by Letters Patent is set forth in the appended claims:

1. A collating method, the method being of the type in which M groups of copies are received for collation, the M groups being in a predetermined sequence, each of the M groups consisting of N copies, the N copies within each individual group being the same, the copies in different ones of the M groups being different, the method being of the type wherein the M groups of N copies each are to be converted into N sets, each set containing M copies, the M copies within each individual set each coming from a different respective one of the M groups and being arranged in the set in said predetermined sequence, the method comprising subjecting a number M of groups of N copies per group to plural successive collating operations, each of the collating operations being performed by laying all the copies of the M groups of N copies per group into a number of infeed bins lower than the number M, then in a cyclical sequence transferring individual copies from successive ones of the infeed bins to an outfeed bin until all of the copies of the M groups of N copies per group have been transferred from the infeed bins to the outfeed bin, all of the copies of the M groups of N copies per group accordingly participating in each one of the plural successive collating operations, and each individual copy in the total number of copies in the M groups of N copies per group accordingly passing from an infeed bin to the outfeed bin once per collating operation and therefore a plurality of times during the performance of the plural successive collating operations, the second and any subsequent collating operation being each performed by taking the copies stacked in the outfeed bin and reintroducing them into infeed bins for performance of another collating operation, the number of successive collating operations performed being such that upon completion of the last of the plural collating operations the outfeed bin has received the desired N sets of M copies each with the M copies in each of the N sets being in said predetermined sequence within the respective set.

2. The collating method defined in claim 1, the method being performed using a conventional collating machine, the infeed bins and outfeed bins being those of the conventional collating machine, the collating machine performing each collating operation by proceeding in a cyclical sequence to transfer successive individual copies from successive ones of the infeed bins utilized to the outfeed bin in a repeated predetermined order without skipping any of the bins utilized or skipping any of the copies in any of the bins utilized.

3. The collating method defined in claim 2, the method being performed using only two infeed bins during each one of the plural successive collating operations.

4. The collating method defined in claim 3, the method being performed using a collating machine having only two infeed bins and provided with copy-removing means operative for removing one copy from one bin and simultaneously therewith removing one copy from the other bin and transferring the two simultaneously removed copies from the respective bins to the outfeed bin with an offset in time so that the copy removed from one bin reaches the outfeed bin before the copy removed from the other bin.

5. A collating machine having plural infeed bins and a common outfeed bin, each bin being provided with copy-removing means operative during one copy-feeding cycle for performing a copy-feeding operation by removing a copy from the respective bin and feeding such copy towards the outfeed bin, the machine being provided with means causing the copy-removing means at the plural infeed bins to operate repeatedly to establish repeated copy-feeding cycles, the collating machine being provided at each infeed bin with copy-counting means and cooperating selector means, the selector means being operative for setting a first number, the copy-counting means being operative for counting copies removed from the respective infeed bin until the number of copies removed equals the number set on the selecting means and in response thereto causing the copy-feeding means at the respective bin to skip one copy-feeding operation during one copy-feeding cycle and then automatically reset and recommence counting of copies removed from the respective infeed bin.

6. A collating machine as defined in claim 5, the copy-counting means and selector means at each infeed bin constituting first copy-counting means and first selector means, the machine being additionally provided at each of the plural infeed bins with second copy-counting means and second selector means, the second selector means being operative for setting a second number, the second copy-counting means being operative for counting copies removed from the respective infeed bin until the number of copies removed equals the number set on the additional selecting means and in response thereto initiating operation of the respective first copy-counting means.

* * * * *